US007887293B2

(12) United States Patent
Frampton et al.

(10) Patent No.: US 7,887,293 B2
(45) Date of Patent: Feb. 15, 2011

(54) FAN ASSEMBLY HAVING IMPROVED SUPPORT ARRANGEMENT

(75) Inventors: Thomas C. Frampton, Zionsville, IN (US); Peter S. Jenkins, Brownsburg, IN (US)

(73) Assignee: Fanimation, Inc., Zionsville, IN (US)

( * ) Notice: Subject to any disclaimer, the term of this patent is extended or adjusted under 35 U.S.C. 154(b) by 930 days.

(21) Appl. No.: 11/807,895

(22) Filed: May 30, 2007

(65) Prior Publication Data

US 2008/0296459 A1 Dec. 4, 2008

(51) Int. Cl.
*F03D 11/04* (2006.01)

(52) U.S. Cl. ..... 416/5; 416/244 R; 248/342

(58) Field of Classification Search ..... 416/5, 416/246, 204 R, 209, 244 R; 248/343, 342
See application file for complete search history.

(56) References Cited

U.S. PATENT DOCUMENTS 4,729,725 A * 3/1988 Markwardt ..... 417/423.15
4,871,327 A * 10/1989 Ridgway et al. ..... 439/543
4,878,806 A * 11/1989 Markwardt ..... 416/5

OTHER PUBLICATIONS

Fanimation Owner's Manual, "The Belleria™ Ceiling Fan," Model No. FP4320, Copyright 2007 Fanimation, Jan. 2007, (14 pages).

Fanimation Owner's Manual, "The Islander® Ceiling Fan," Model No. FP320, Copyright 2007 Fanimation, Mar. 2007, (16 pages).

"Veritys Ceiling Fans" document, "The 'Orbit' Ceiling Fan," Publicly available at least as early as May 29, 2007 (1 page).

Nine (9) photographs of "Wind Chaser" fan that was publicly available at least as early as May 29, 2007 (3 pages).

* cited by examiner

*Primary Examiner*—Edward Look
*Assistant Examiner*—Dwayne J White
(74) *Attorney, Agent, or Firm*—Maginot, Moore & Beck

(57) ABSTRACT

A fan assembly includes an elongate support member having an end portion that has a first fastener opening defined therein. The fan assembly further includes a motor assembly including (i) a motor having an output shaft, and (ii) a support assembly that supports the motor, the support assembly having a receptacle configured to receive the end portion of the elongate support member therein, and the receptacle having a second fastener opening defined therein. In addition, the fan assembly includes at least one fan blade coupled to the output shaft of the motor so that rotation of the output shaft causes rotation of the at least one fan blade. The fan assembly also includes a resilient interface member having a third fastener opening defined therein, the resilient interface member being (i) positioned within the receptacle, and (ii) interposed between the end portion of the elongate support member and receptacle. Further, the fan assembly includes a fastener extending through the first fastener opening, the second fastener opening, and the third fastener opening.

38 Claims, 26 Drawing Sheets

FAN ASSEMBLY HAVING IMPROVED SUPPORT ARRANGEMENT

CROSS REFERENCE TO RELATED APPLICATIONS

Cross reference is made to copending (i) U.S. patent application Ser. No. 11/807,894, entitled "Fan Assembly having Protective Motor Housing that Accommodates Cyclic Movement" by Thomas C. Frampton, John Moody, and Peter Jenkins, and (ii) U.S. patent application Ser. No. 11/807,875, entitled "Fan Assembly having Improved Hanger Arrangement" by Thomas C. Frampton, John Moody, and Peter Jenkins which are assigned to the same assignee as the present invention, and which is filed concurrently herewith. The disclosures of the two above-identified patent applications are hereby totally incorporated by reference in their entirety.

BACKGROUND

The present disclosure relates generally to fan assemblies, and more particularly, to support assemblies for fans.

Artificially induced airflow has long been used to cool people in warm weather. With mass production of small electrical motors, fans have come into wide spread use. Fans increase airflow thereby enhancing evaporative cooling on a person's skin. On the other hand, fans may be used to provide a heating effect. In particular, ceiling mounted fans may be operated to move warm air from an area adjacent a room ceiling downwardly to lower portions of the room.

Many fans are suspended from overhead structures such as ceilings or sloped walls. One goal of fan designers is to create quieter fans such as fans having reduced vibrational noise created during operation thereof. Another goal of fan designers is to develop fans that utilize fewer parts. Still another goal of fan designers is to develop fans that are easier to assemble by a customer. Yet another goal of fan designers is to develop fans that are assembled from components (such as down rods) that are common to variety of fan types such as wet location fans and dry location fans. Moreover, another goal of fan designers is to develop fans that require fewer tools during assembly of the fan by a customer.

What is needed therefore is an improved fan assembly. What is also needed is a fan assembly that is quieter. What is further needed is a fan assembly that has reduced vibrational noise during operation thereof. What is additionally needed is a fan assembly that utilizes fewer parts. What is also needed is a fan assembly that is easier to assemble by a customer. What is further needed is a fan assembly that is assembled from components that are common to variety of fan types such as wet location fans and dry location fans. What is further needed is a fan assembly that requires fewer tools during assembly of the fan by a customer.

SUMMARY

In accordance with one embodiment of the disclosure, there is provided a fan assembly that includes an elongate support member having an end portion that has a first fastener opening defined therein. The fan assembly further includes a motor assembly including (i) a motor having an output shaft, and (ii) a support assembly that supports the motor, the support assembly having a receptacle configured to receive the end portion of the elongate support member therein, and the receptacle having a second fastener opening defined therein. In addition, the fan assembly includes at least one fan blade coupled to the output shaft of the motor so that rotation of the output shaft causes rotation of the at least one fan blade. The fan assembly also includes a resilient interface member having a third fastener opening defined therein, the resilient interface member being (i) positioned within the receptacle, and (ii) interposed between the end portion of the elongate support member and receptacle. Further, the fan assembly includes a fastener extending through the first fastener opening, the second fastener opening, and the third fastener opening.

Pursuant to another embodiment of the disclosure, there is provided a fan assembly that includes an elongate support member having an end portion. The fan assembly further includes a motor assembly including (i) a motor having an output shaft, and (ii) a support assembly that supports the motor, the support assembly having a receptacle defining an interior sidewall. In addition, the fan assembly includes at least one fan blade coupled to the output shaft of the motor so that rotation of the output shaft causes rotation of the at least one fan blade. The fan assembly also includes an elastomeric interface member interposed between the end portion of the elongate support member and the interior sidewall of the receptacle.

In accordance with yet another embodiment of the disclosure, there is provided a fan assembly that includes an elongate support member and a motor assembly including (i) a motor having an output shaft, and (ii) a support assembly that supports the motor. The fan assembly further includes at least one fan blade coupled to the output shaft of the motor so that rotation of the output shaft causes rotation of the at least one fan blade. In addition, the fan assembly includes an elastomeric interface member. One of the support assembly and the elongate support member includes a receptacle. The other of the support assembly and the elongate support member includes a part thereof that is positioned within the receptacle. The elastomeric interface member is interposed between the receptacle and the part.

DESCRIPTION OF THE PREFERRED EMBODIMENTS

Figure 1:
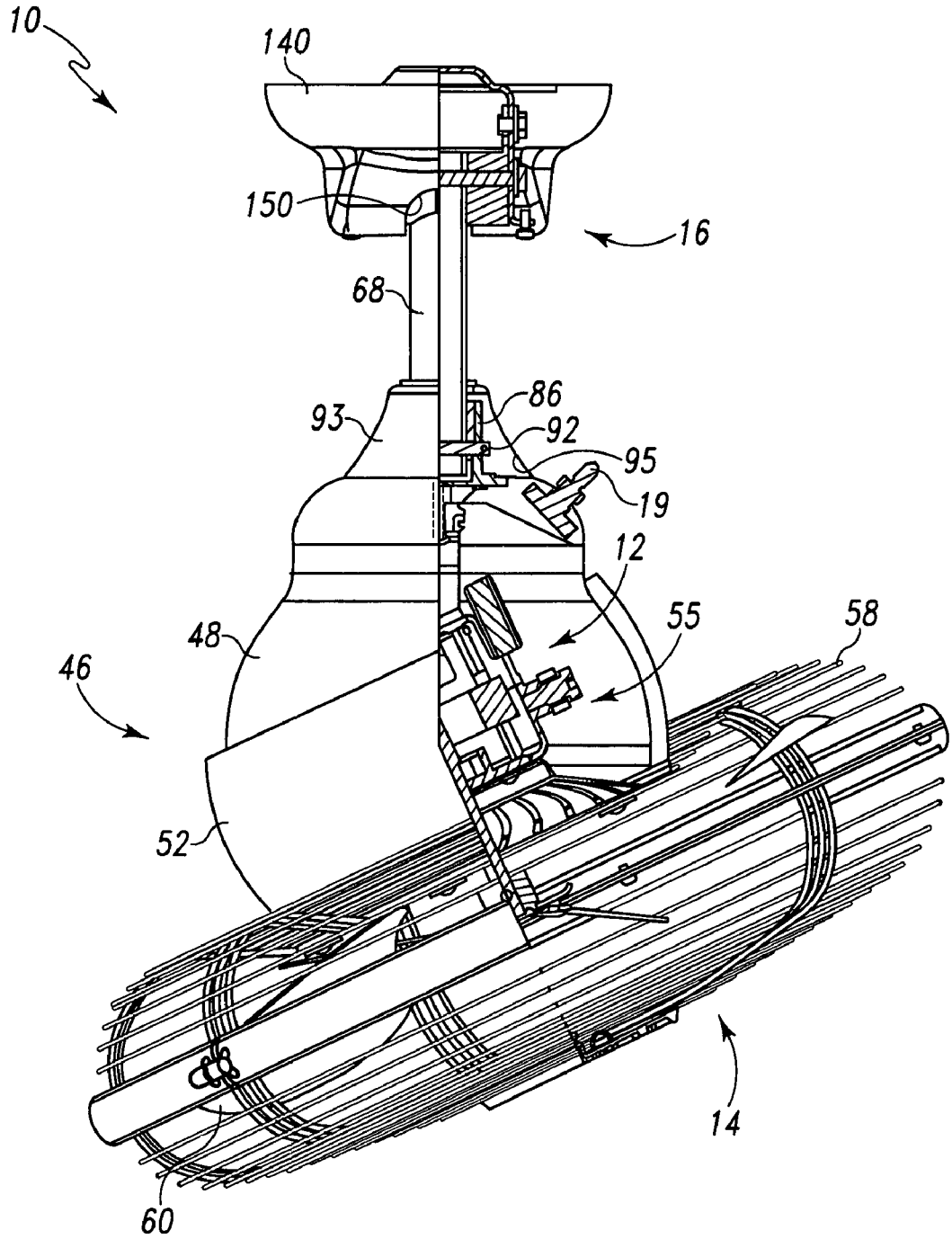
FIG. 1 is partial side elevational, partial cross sectional view of the fan assembly according to the present disclosure.
Figure 2:
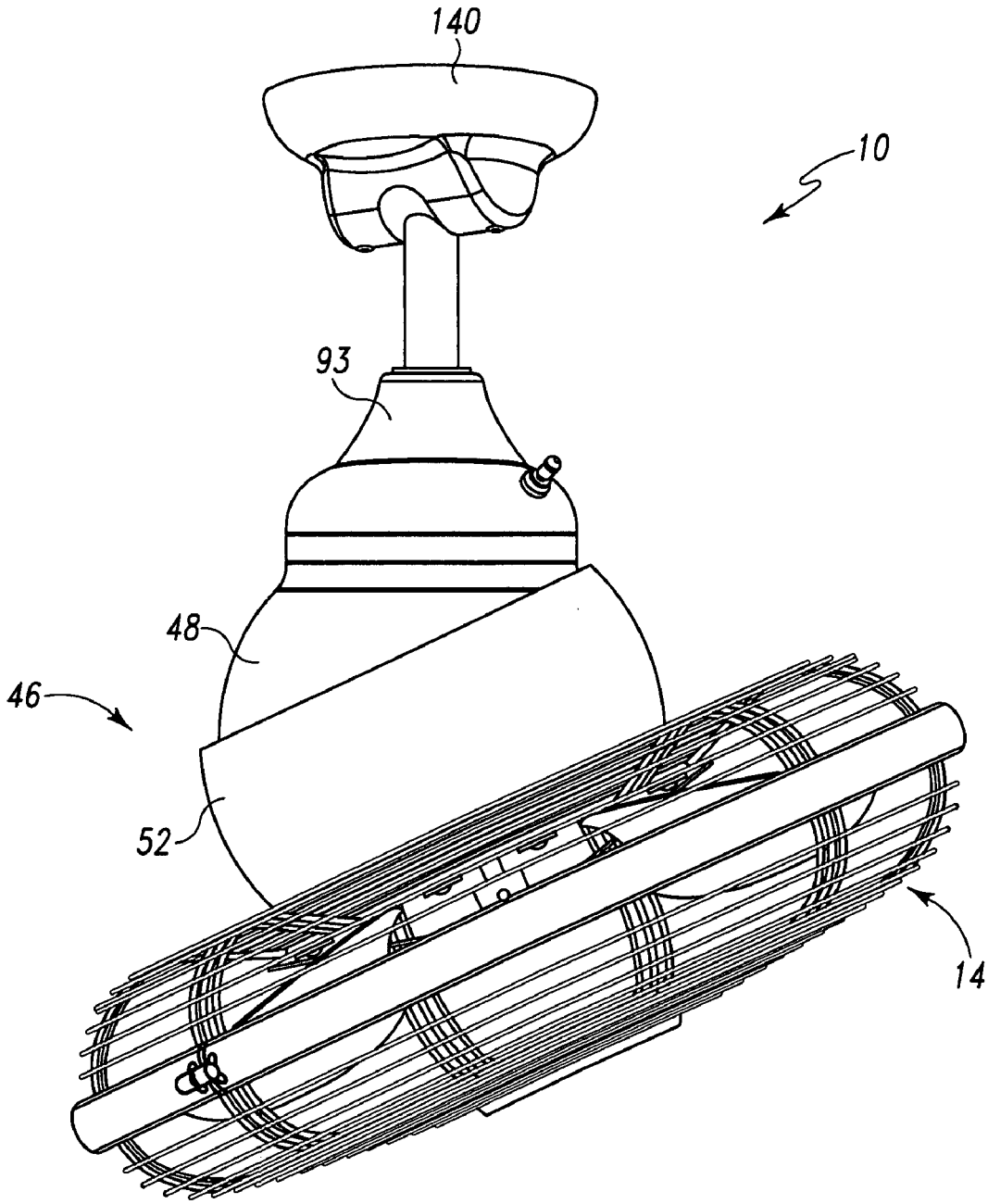
FIGS. 2-6 are a series of side elevational views depicting sequential movement of the fan assembly of FIG. 1 in an orbital path of movement.
Figure 3:
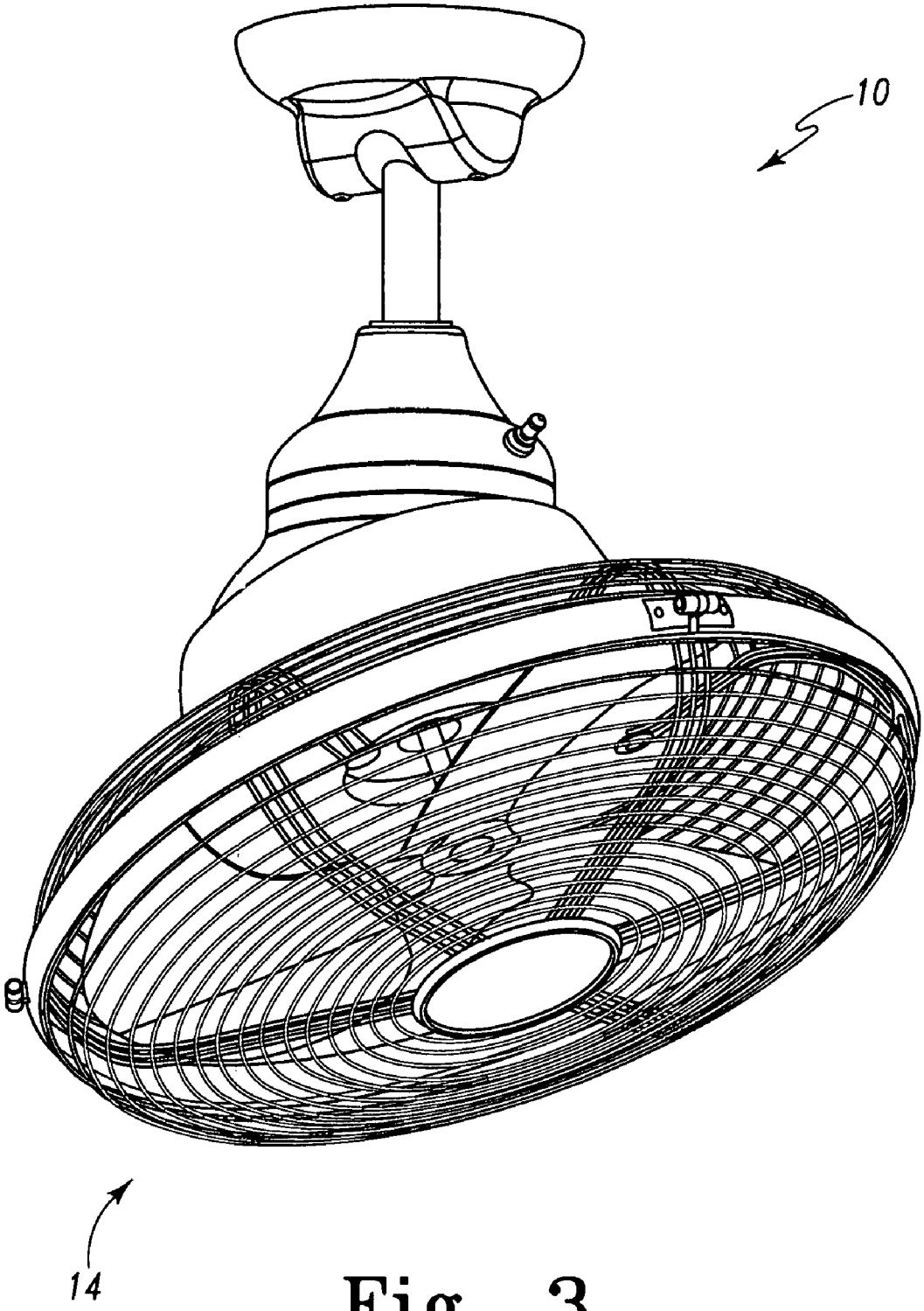
Figure 4:
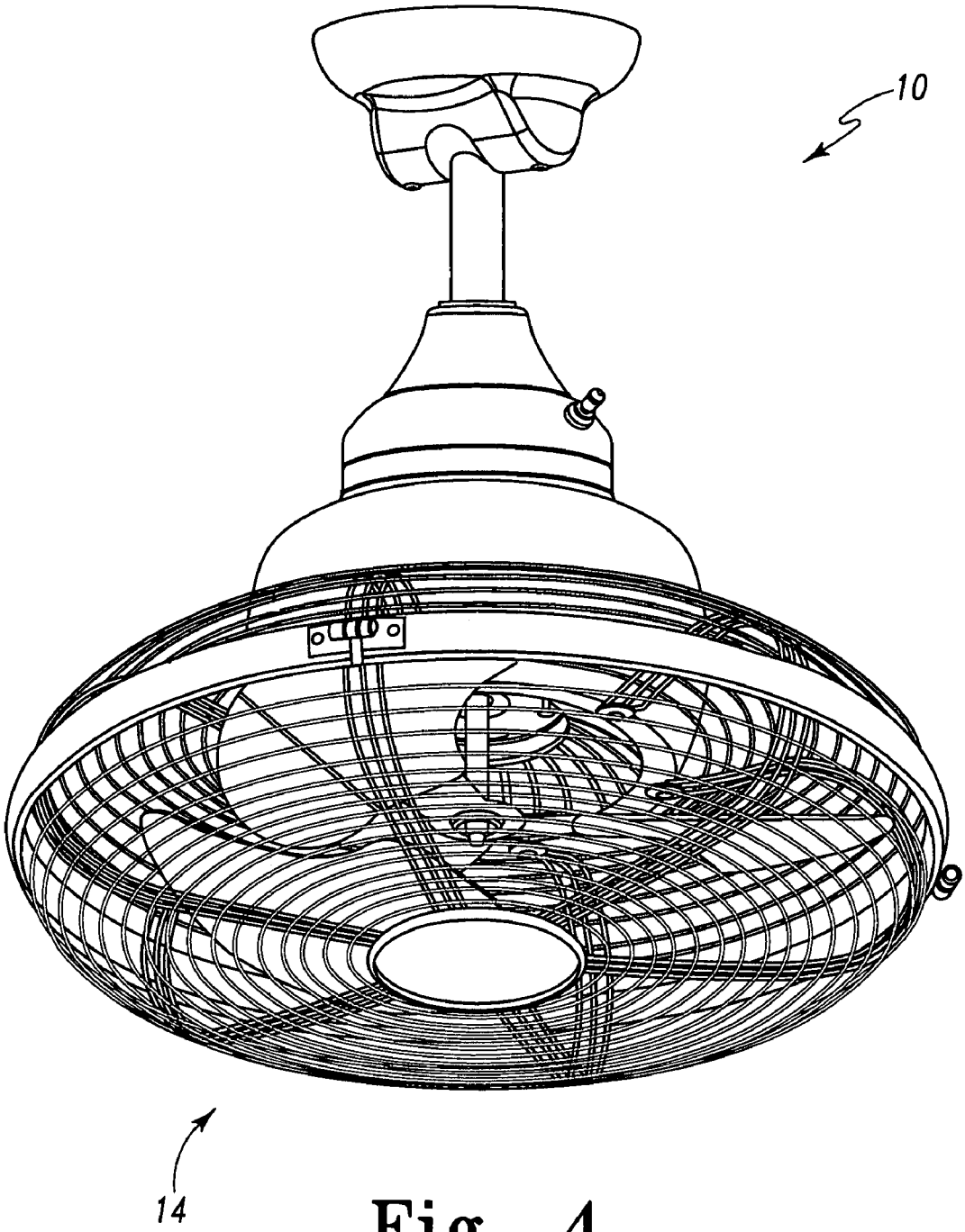
Figure 5:
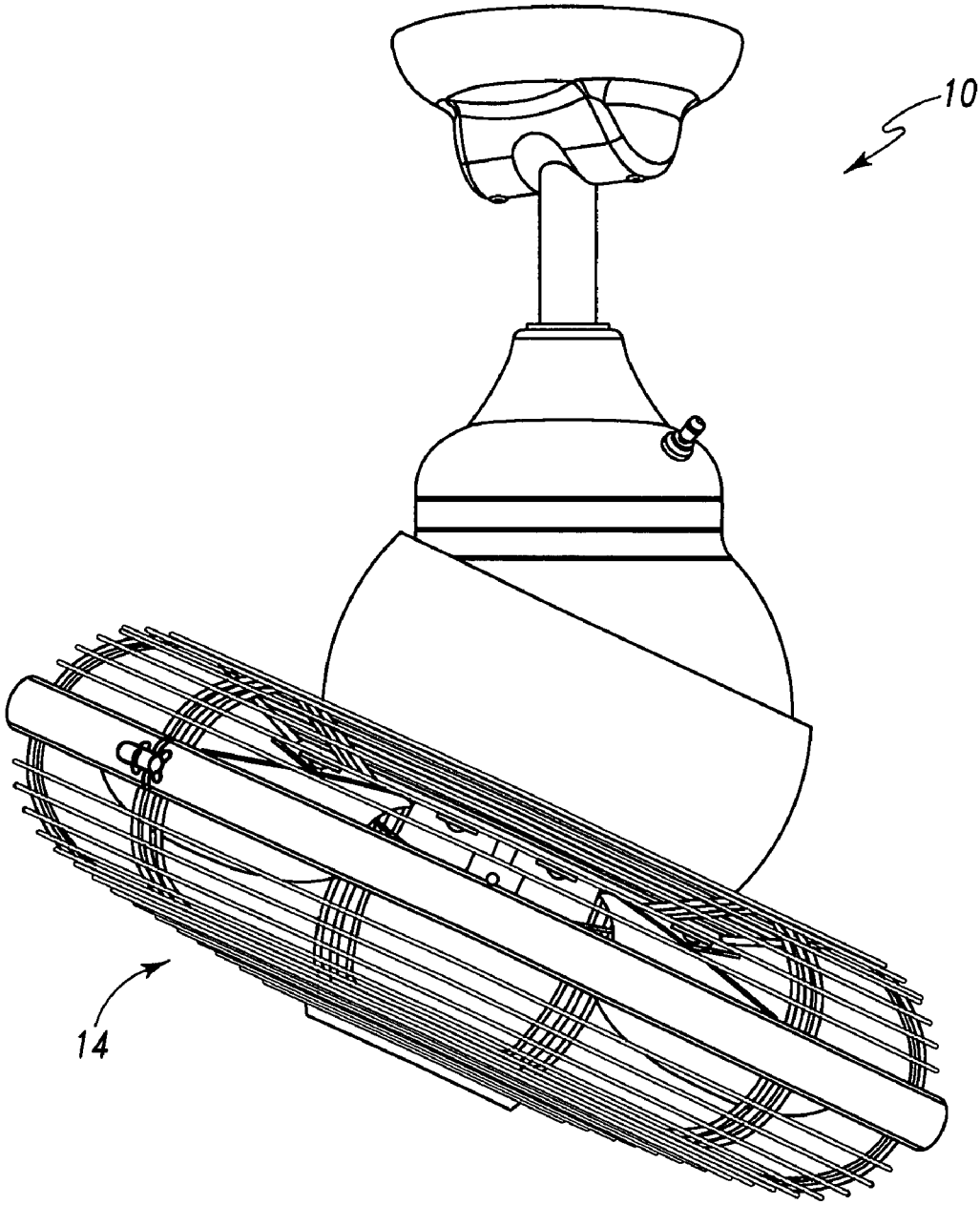

While the assembly described herein is susceptible to various modifications and alternative forms, specific embodiments thereof have been shown by way of example in the drawings and will herein be described in detail. It should be understood, however, that there is no intent to limit the assembly to the particular forms disclosed, but on the contrary, the intention is to cover all modifications, equivalents, and alternatives falling within the spirit and scope of the invention as defined by the appended claims.

Turning now to FIG. 1, there is shown a fan assembly 10. The fan assembly 10 includes a motor assembly 12, a fan blade assembly 14, and a bracket assembly 16. The fan assembly 10 is operable to move the fan blade assembly 14 in a cyclic movement. In particular, during operation of the fan assembly 10, the fan blade assembly 14 is moved in an orbital path of movement as depicted in FIGS. 2-6.

Figure 6:
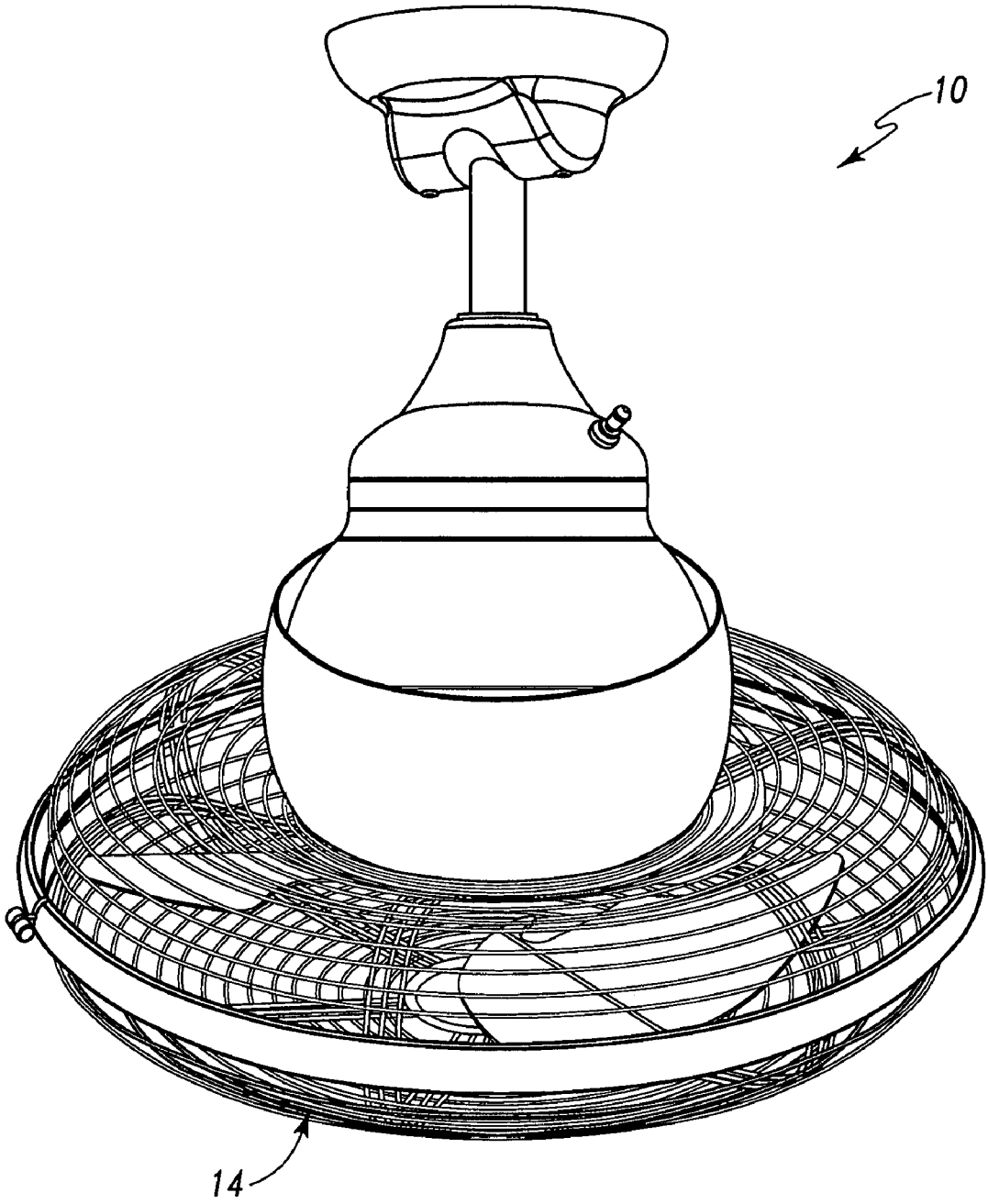
Figure 6A:
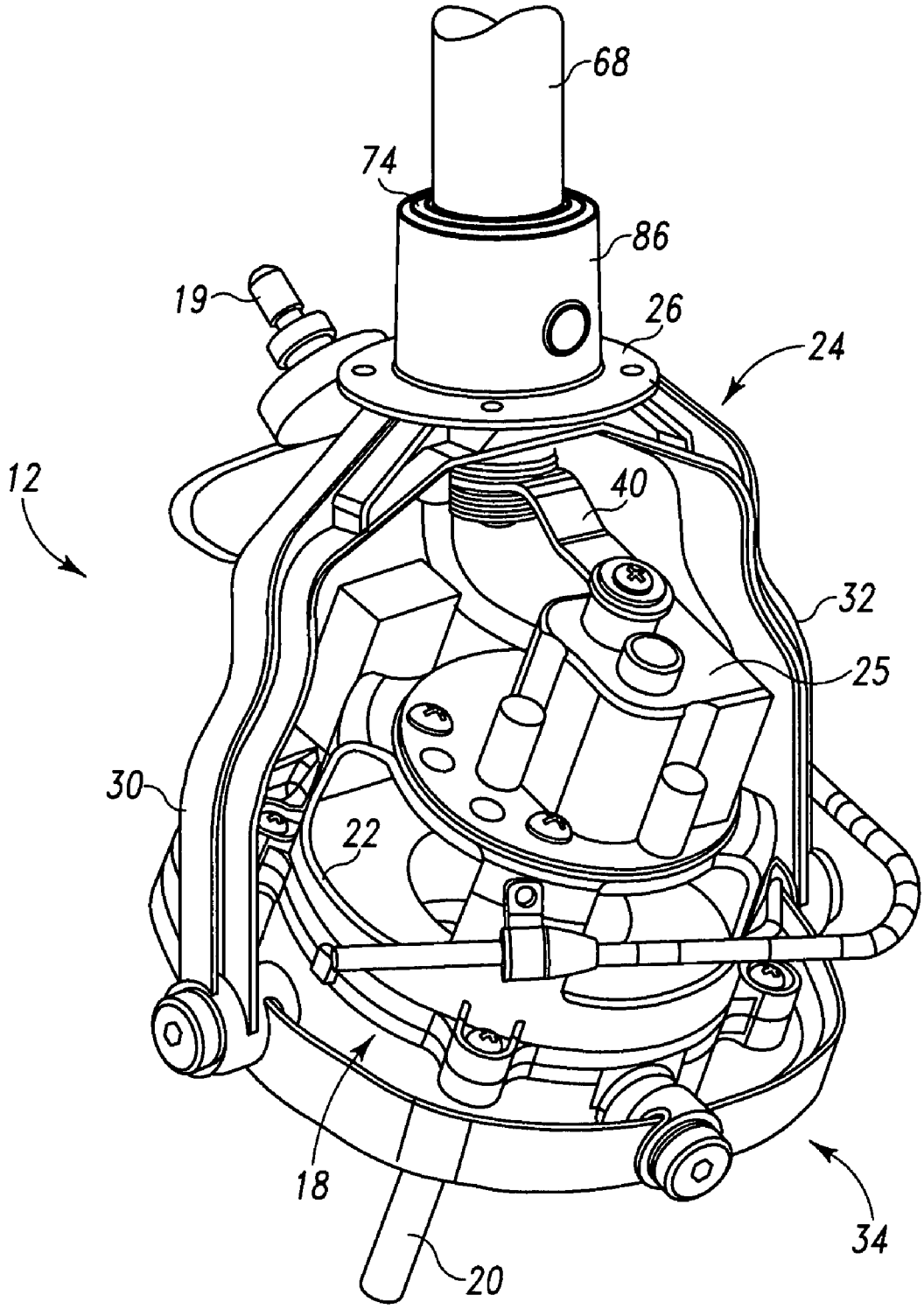
FIG. 6A is a perspective view of the motor assembly of the fan assembly of FIG. 1.
Figure 7:
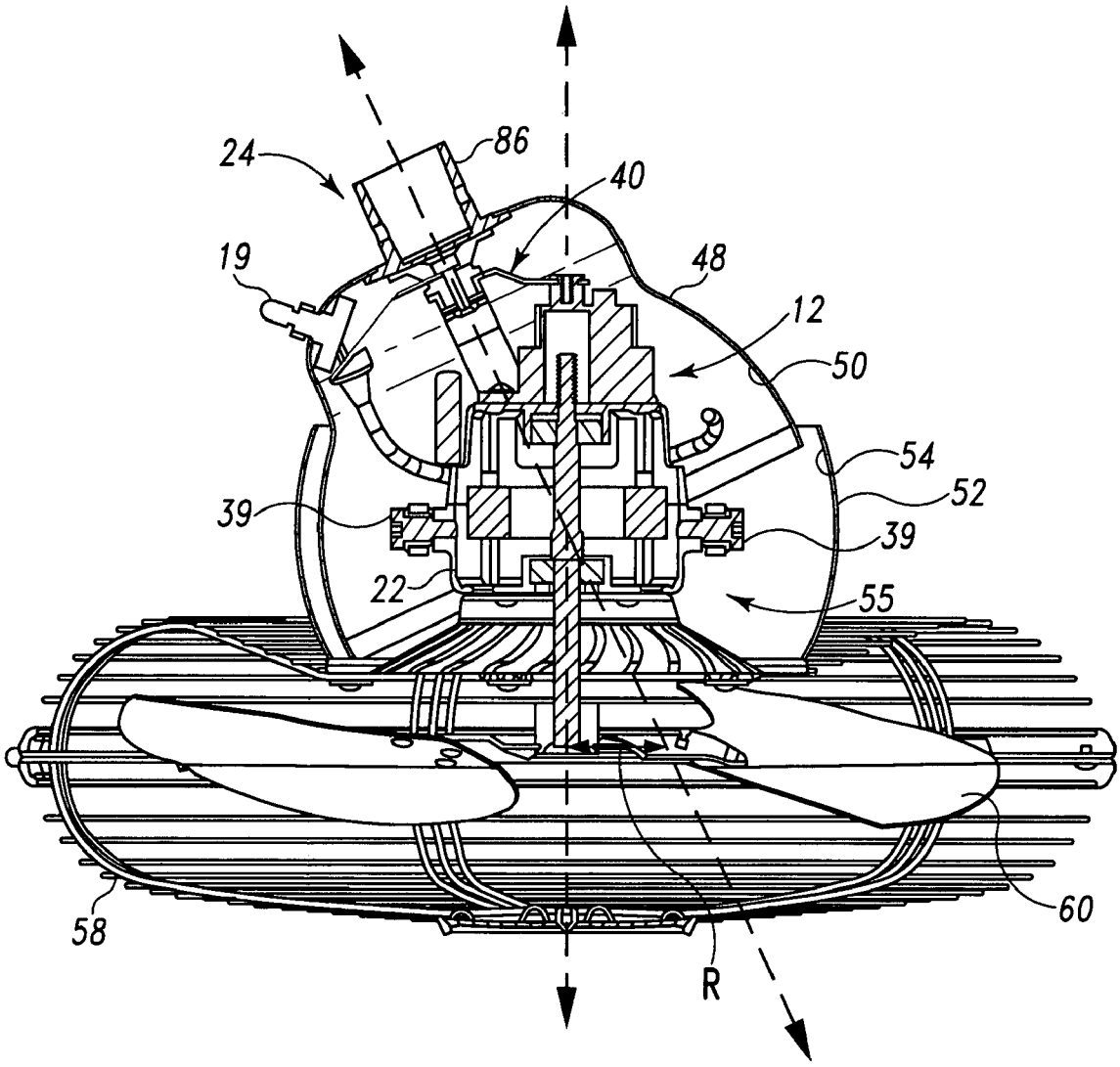
FIGS. 7-8 are cross sectional views of a part of the fan assembly of FIG. 1, each at a different point in its orbital path of movement.

Movement of the fan blade assembly 14 is enabled by the configuration of the motor assembly 12. Referring now to FIGS. 6A and 7-13, the motor assembly 12 includes a motor 18 having a rotatable output shaft 20 which is switched between an "off" state and an "on" state by a switch 19. The motor 18 further includes a motor structure 22. The output shaft 20 is rotatable in relation to the motor structure 22. The motor assembly 12 further includes a support assembly 24 that supports the motor 18 as shown in FIG. 6A. The motor assembly 12 also includes a gear reduction mechanism 25. The gear reduction mechanism 25 includes an input (not shown) that is coupled to the output shaft 20 of the motor 18. The gear reduction mechanism 25 also includes an output 27. Rotation of the output shaft 20 at a speed of X rpm causes rotation of the output 27 at a speed of Y rpm, wherein Y is much less than X.

During movement of the fan blade assembly 14 in an orbital path of movement, the motor 18 is moved so that the output shaft 20 scribes a circle having a radius R (see FIG. 7) in a repeating path of movement. Such movement of the fan blade assembly 14 during operation of the fan assembly 10 results in a flow of air generated by the fan assembly 10 that is distributed over a relatively large area in comparison to a fan assembly that has a stationary fan blade assembly (i.e. a fan blade assembly that is being rotated by the motor but not otherwise moving in a cyclic manner).

Figure 10:
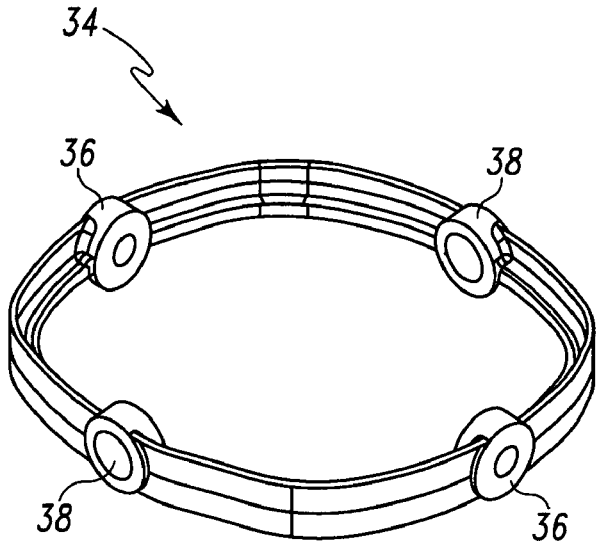
FIG. 10 is a perspective view of the intermediate support member of the support assembly of the motor assembly of the fan assembly of FIG. 1.
Figure 9:
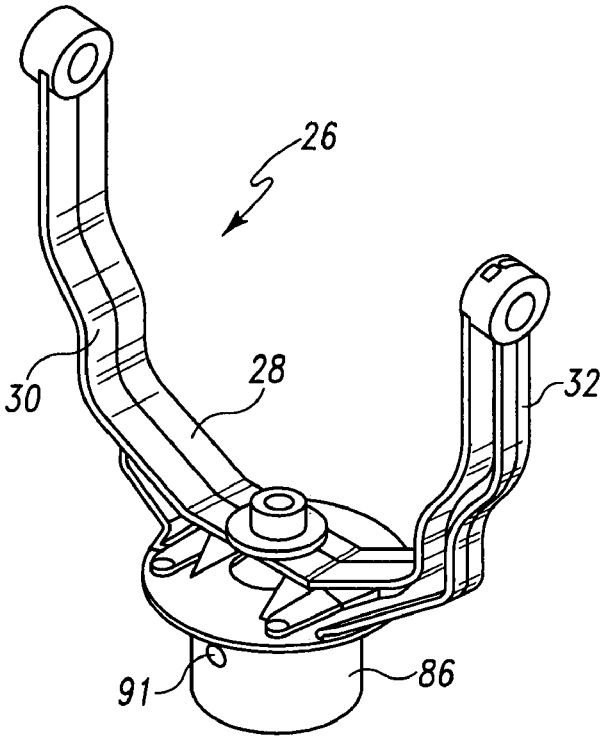
FIG. 9 is a perspective view of the frame of the support assembly of the motor assembly of the fan assembly of FIG. 1.
Figure 12:
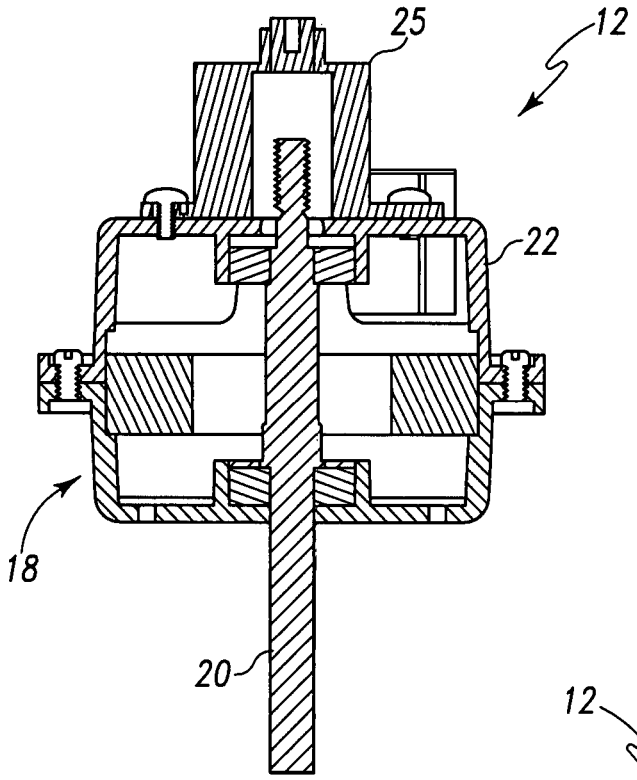
FIG. 12 is a cross sectional view of the motor and the gear reduction mechanism of the motor assembly of the fan assembly of FIG. 1.
Figure 13:
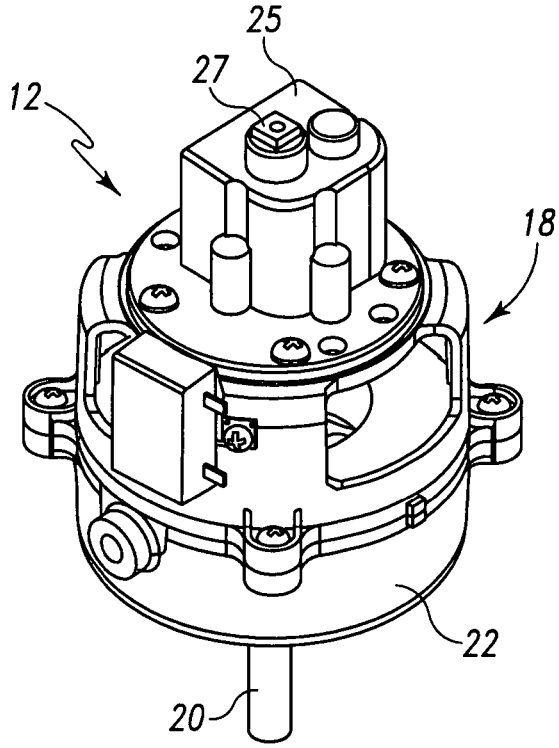
FIG. 13 is a perspective view of the motor and the gear reduction mechanism of the motor assembly of the fan assembly of FIG. 1.
Figure 14:
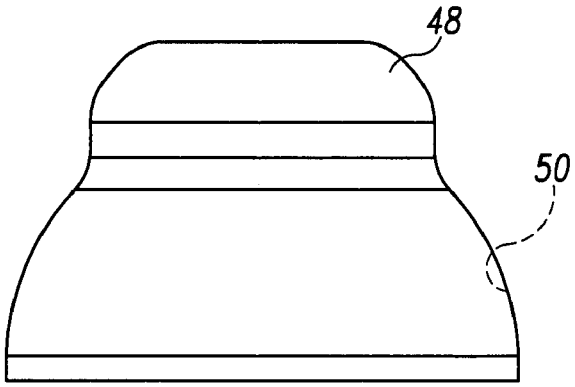
FIG. 14 is a side elevational view of a housing portion of the housing of the fan assembly of FIG. 1.
Figure 15:
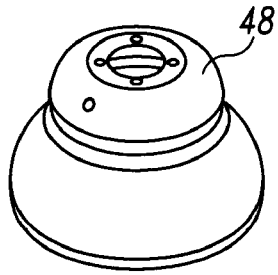
FIG. 15 is a perspective view of the housing portion of FIG. 14.

The support assembly 24 includes a frame 26 that defines a yoke 28 having a first arm 30 and a second arm 32 as shown in FIG. 9. The support assembly 24 further includes an intermediate support member 34 as shown in FIG. 10. The support member 34 is pivotably secured to the yoke 28 at a pair of fastener bosses 36. A pair of fasteners 37 respectively extends through the fastener bosses 36. The intermediate support member 34 is further pivotably secured to the motor structure 22 at another pair of fastener bosses 38. Another pair of fasteners 39 respectively extends through the fastener bosses 38. The support assembly 24 additionally includes a link 40. A first end 42 of the link 40 is rotatably coupled to the frame 26. A second end 44 of the link 40 is fixedly coupled to the output 27 of the gear reduction mechanism 25.

As discussed above, the output 27 of the gear reduction mechanism 25 is caused to rotate in response to rotation of the output shaft 20 of the motor 18. Rotation of the output 27 causes the motor structure 22 to move in a cyclic path of movement which is guided by the link 40. Note that the link 40 pivotably rotates in relation to the frame 26 during such movement of the motor structure 22. Also note that the motor structure 22 is caused to pivot in relation to the intermediate support member 34 during such movement of the motor structure 22. In addition, the intermediate support member 34 is caused to pivot in relation to the frame 26 during such movement of the motor structure 22. Movement of the intermediate support member 34, the motor structure 22, and the link 40 in the above manner causes the output shaft 20 to move such that it scribes a circle having the radius R in a repeating path of movement (see FIG. 7). Further, movement of the intermediate support member 34, the motor structure 22, and the link 40 in the above manner causes the fan blade assembly 14 to move in an orbital path of movement.

Figure 16:
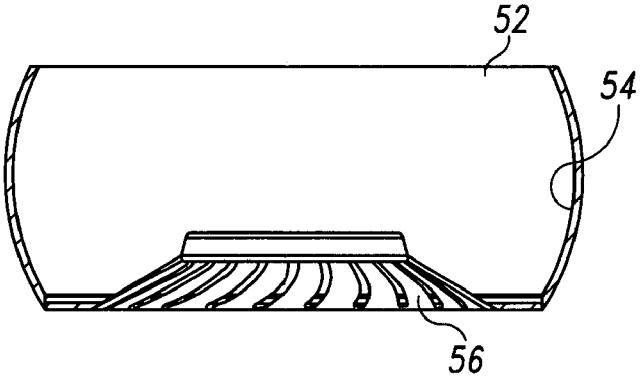
FIG. 16 is a cross sectional view of another housing portion of the housing of the fan assembly of FIG. 1.
Figure 17:
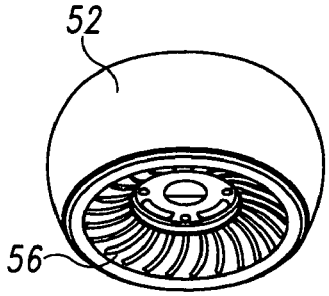
FIG. 17 is a perspective view of the housing portion of FIG. 16.

During movement of the various components as described above, the intermediate support member 34, the motor structure 22, and the link 40 are protected by a housing 46 as shown in FIGS. 2-6. The housing 46 includes a housing portion 48 defining a cavity 50, and another housing portion 52 defining another cavity 54. The cavity 50 and the cavity 54 collectively define a space 55 in which such moving components are located. A barrier 56 is attached to the housing portion 52 as shown in FIGS. 16 and 17. The barrier 56 has a plurality of apertures defined therein. The housing portion 48 is secured in fixed relation to the frame 26. The housing portion 52 is secured in fixed relation to the motor structure 22. Thus, movement of the motor structure 22 causes movement of the housing portion 52. As shown in FIGS. 2-6, the housing portion 48 is movable in relation to the housing portion 52 so that the portions 48, 52 create a protective shroud positioned completely around the moving motor assembly components, namely, the intermediate support member 34, the motor structure 22, and the link 40.

Figure 19:
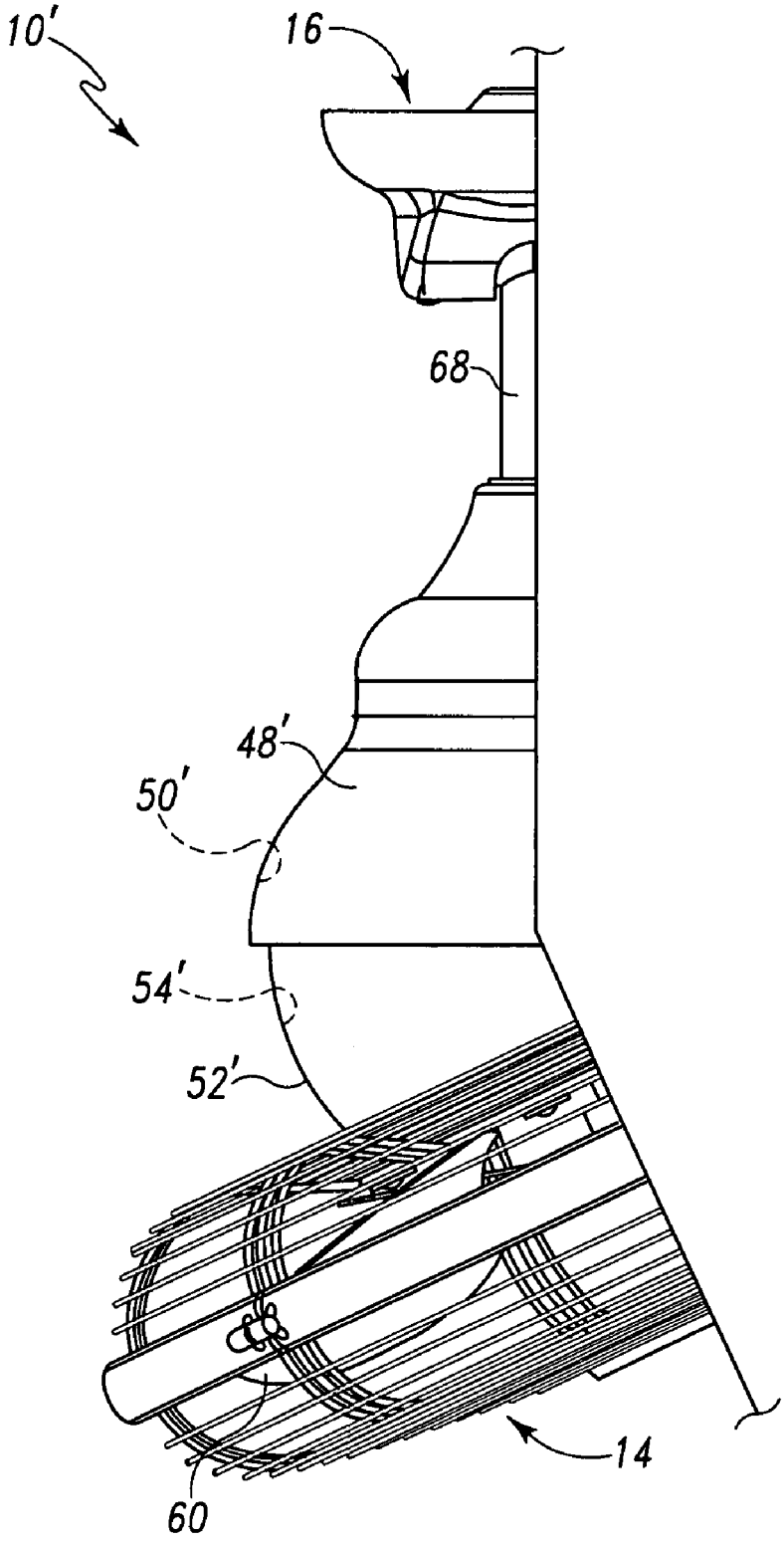
FIG. 19 is a fragmentary elevational view of an alternative fan assembly according to the present disclosure.

Note that during movement of the housing portion 52 in relation to the housing portion 48, the housing portion 48 is partially positioned within the cavity 54 of the housing portion 52. It should be readily appreciated that in an alternative arrangement of the fan assembly 10' shown in FIG. 19, the housing portions 48', 52' may be configured so that the housing portion 48' is the outer housing portion and the housing portion 52' is the inner housing portion. In this alternative arrangement, the housing portion 52' is partially positioned within the cavity 50' of the housing portion 48' during movement of the housing portion 52' in relation to the housing portion 48'.

A fan blade guard 58 is positioned around the fan blade assembly 14. The fan blade guard 58 is secured in fixed relation to the motor structure 22. Accordingly, movement of the motor structure 22 in the cyclic path of movement causes movement of the fan blade guard 58 in relation to the frame 26.

Figure 18:
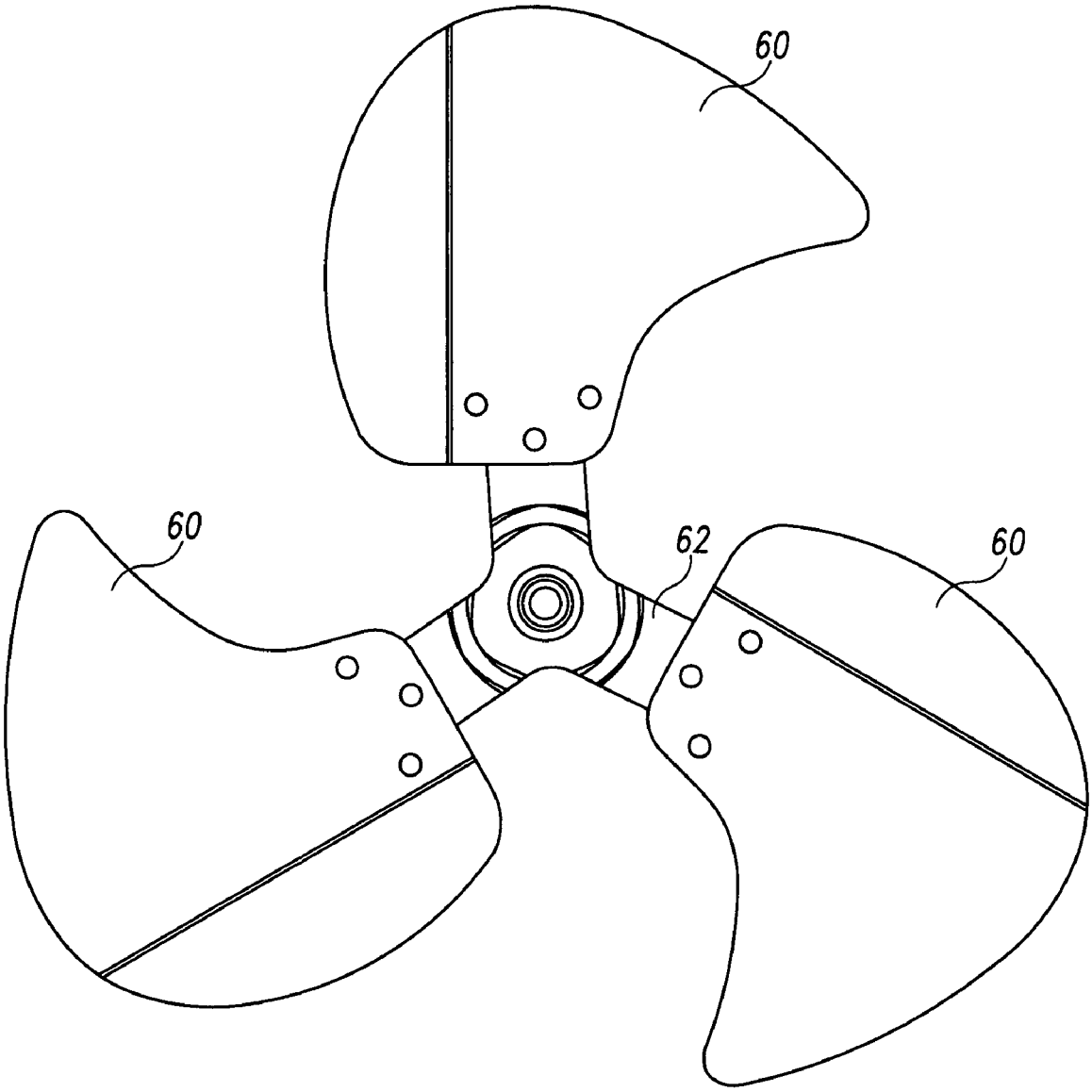
FIG. 18 is an elevational view of the fan blade assembly of the fan assembly of FIG. 1.

The fan blade assembly 14 includes a plurality of fan blades 60 as shown in FIG. 18. Each of the plurality of fan blades 60 are connected to a hub 62. In turn, the hub 62 is coupled to the output shaft 20 of the motor 18. Rotation of the output shaft 20 causes rotation of each of the fan blades 60 in a recirculating path of movement.

Figure 20:
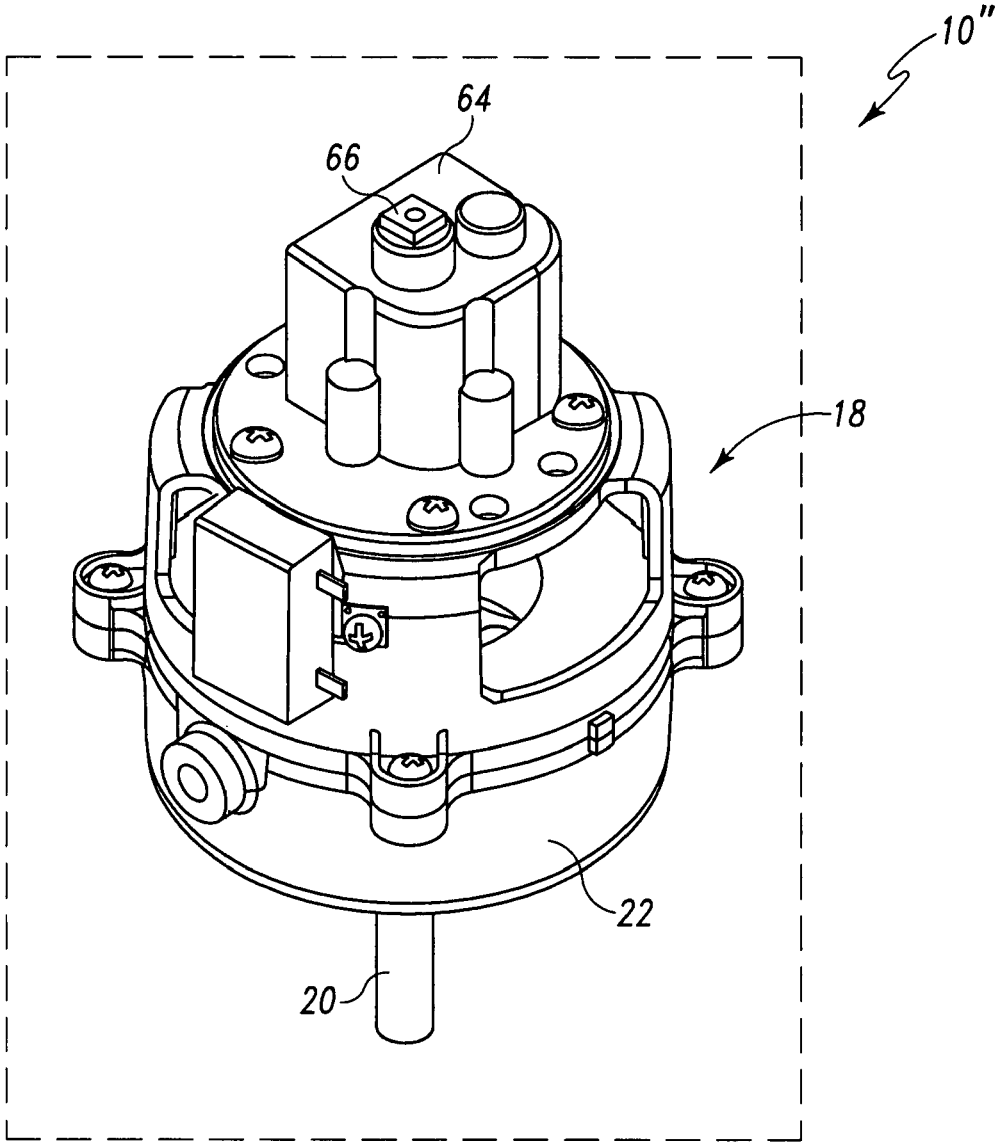
FIG. 20 is a partial schematic, partial perspective view of a yet another alternative fan assembly according to the present disclosure.

In a further alternative arrangement, there is shown a fan assembly 10" in FIG. 20 that does not incorporate a gear reduction mechanism 25 for driving the motor structure 22 in a cyclic path of movement. Rather, the fan assembly 10" incorporates a second motor 64 that is attached to the motor structure 22 for this purpose. The second motor 64 includes an output 66 that is coupled to the second end 44 of the link 40 in a manner similar to the coupling of the output 27 of the gear reduction mechanism 25 to the link 40. The output 66 is driven at the same speed as the output 27 of the gear reduction mechanism 25. The second motor 64 includes components (not shown) for selectively actuating the second motor 64. For example, the second motor 64 may be selectively actuated by a hand-held infrared controller (not shown) similar to a remote infrared controller configured to operate a television system, a stereo system, or other consumer electronic device. In this way, the orbital movement of the fan blade assembly 14 in relation to the frame 26 may be selectively halted while the motor 18 and associated fan blade assembly 14 are still being operated to generate a flow of air.

Figure 22:
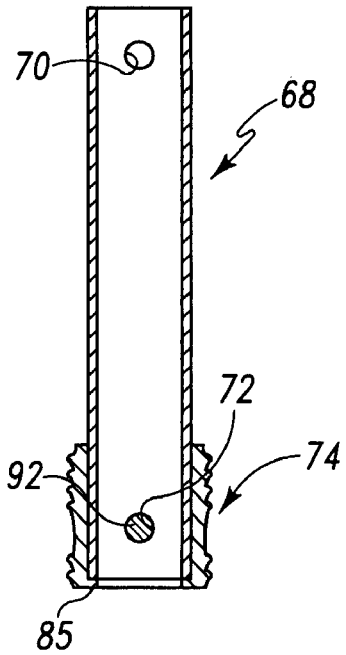
FIG. 22 is a cross sectional view of the elongate support member and the resilient interface member of FIG. 21.
Figure 21:
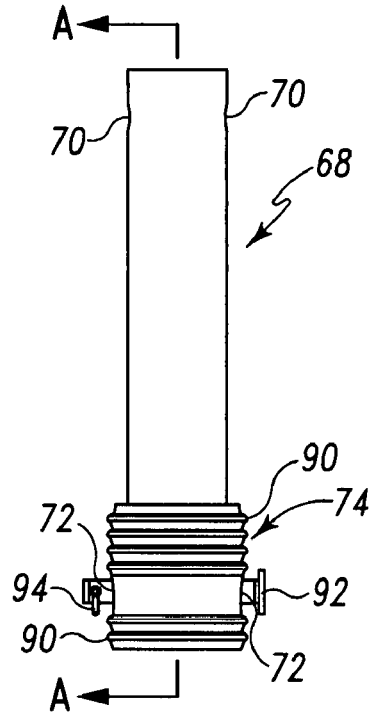
FIG. 21 is an elevational view of the elongate support member and the resilient interface member of the fan assembly of FIG. 1.
Figure 23:
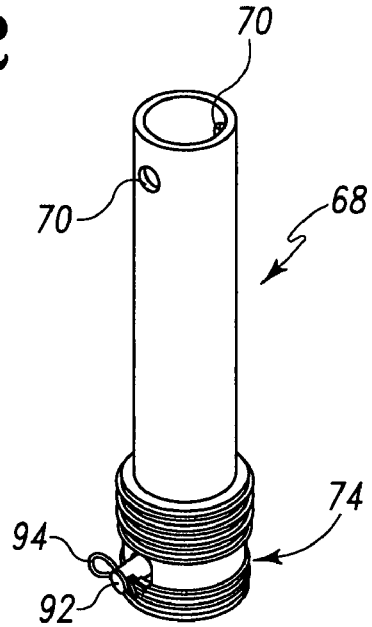
FIG. 23 is a perspective view of the elongate support member and the resilient interface member of FIG. 21.
Figure 25:
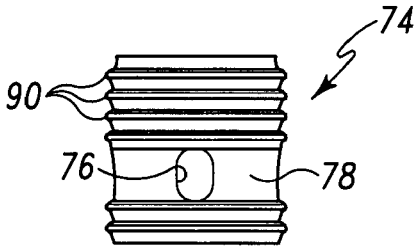
FIG. 25 is another elevational view of the resilient interface member of FIG. 21, showing the resilient interface member rotated 900 from its position shown in FIG. 24.
Figure 24:
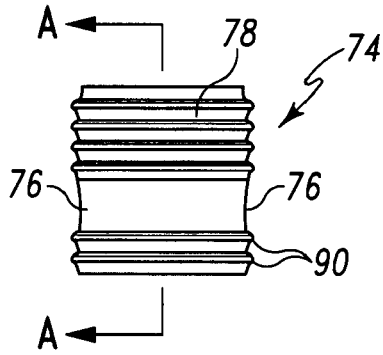
FIG. 24 is an elevational view of the resilient interface member of FIG. 21.
Figure 27:
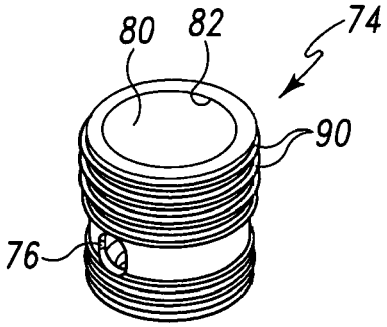
FIG. 27 is a perspective view of the resilient interface member of FIG. 21.
Figure 26:
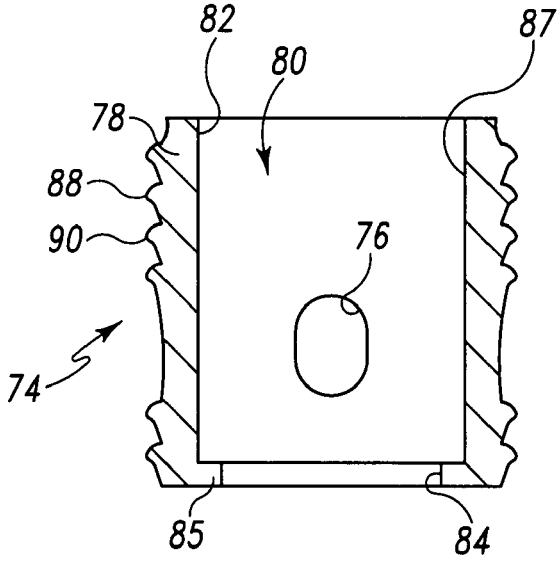
FIG. 26 is a cross sectional view of the resilient interface member of FIG. 21.

The fan assembly 10 further includes a downrod or elongate support member 68 as shown in FIGS. 1 and 21-23. The elongate support member 68 is a cylindrically-shaped member. The elongate support member 68 includes an upper end portion having a pair of fastener openings 70 defined therein, and a lower end portion having another pair of fastener openings 72 defined therein. A resilient interface member 74 is positioned around the lower end portion of the elongate support member 68 as shown in FIGS. 21-23. The resilient interface member 74 has a pair of fastener openings 76 defined in a sidewall thereof. The resilient interface member 74 includes a sleeve 78 that defines a central passageway 80 as shown in FIGS. 24-27. The sleeve 78 has an end that defines an orifice 82 and another end that defines another orifice 84. The sleeve 78 has a lip 85 at the second end that defines the orifice 84. The sleeve 78 defines an interior sidewall surface 87 and an exterior sidewall surface 88. The exterior sidewall surface defines a plurality of ribs 90 that extend around the elongate support member 68 as shown in FIGS. 21-23.

Figure 8:
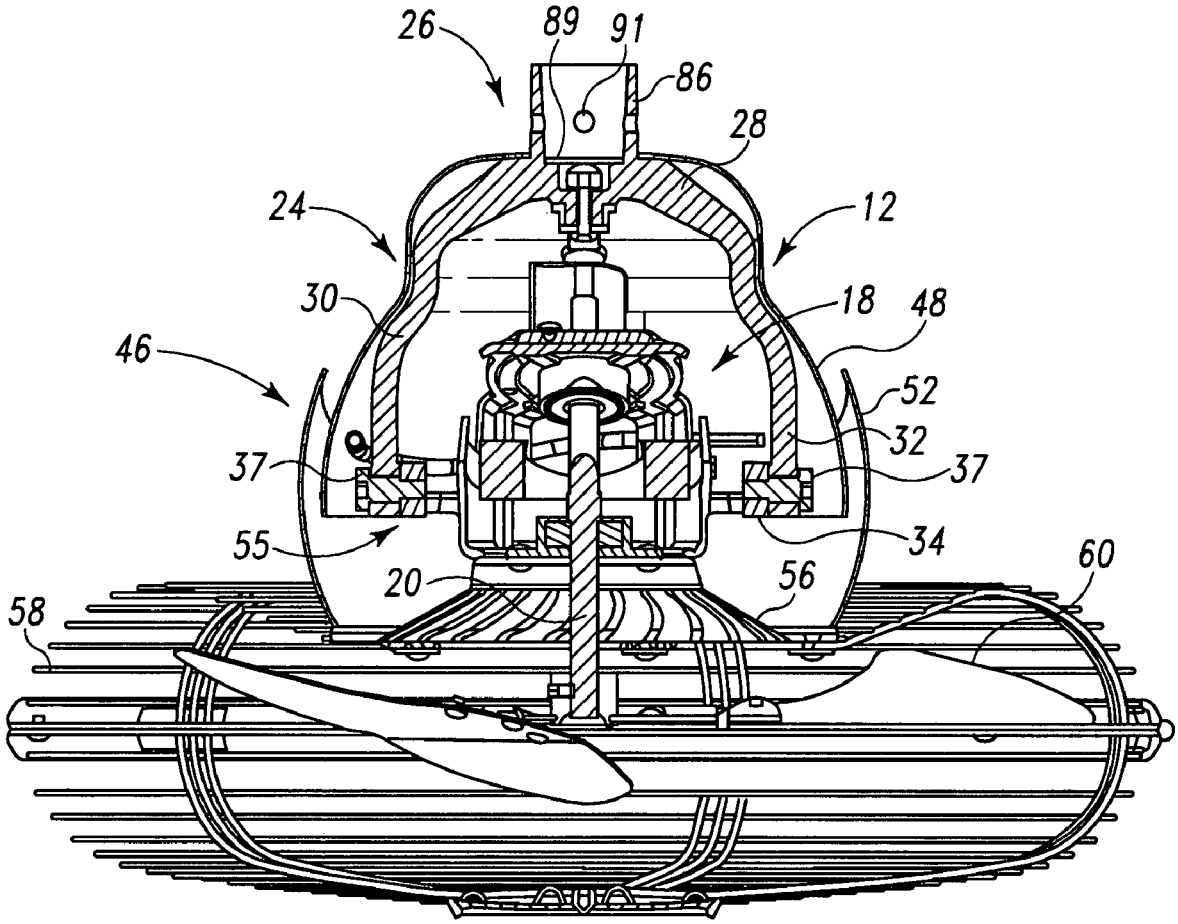
Figure 11:
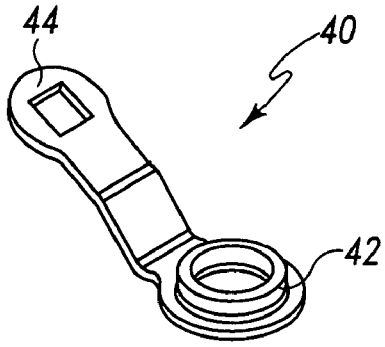
FIG. 11 is a perspective view of the link of the support assembly of the motor assembly of the fan assembly of FIG. 1.
Figure 28:
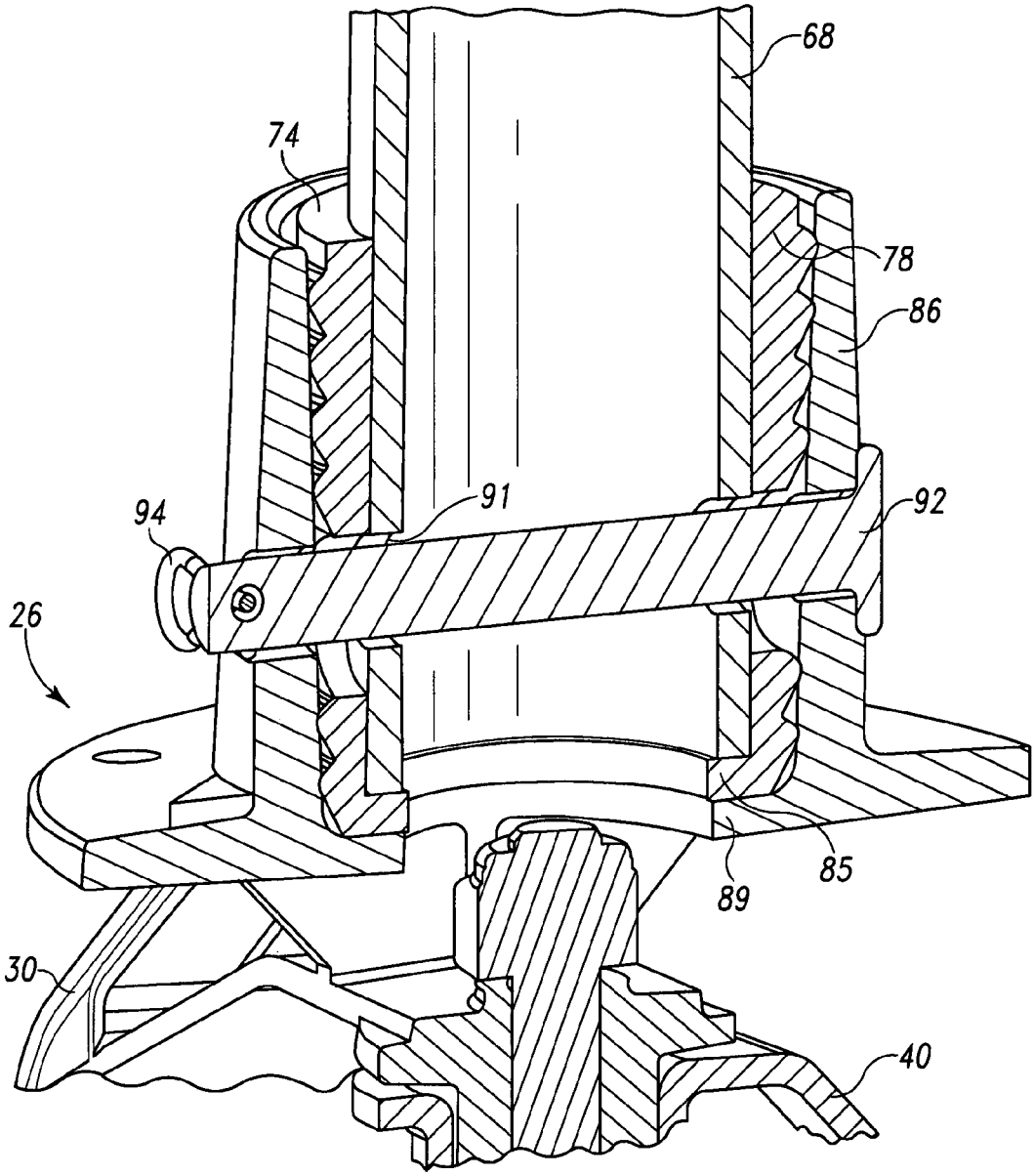
FIG. 28 is a cross sectional view of the elongate support member, the resilient interface member, and the receptacle of the fan assembly of FIG. 1.

The frame 26 includes a receptacle 86 as shown in FIGS. 7-9 and 28. The receptacle has a pair of fastener openings 91 defined therein. The lower end portion of the elongate support member 68 and the resilient interface member 74 are positioned in the receptacle 86 as shown in FIG. 28 so that all of the fastener openings 72, 76, 91 are aligned. A fastener 92 is positioned to extend through all of the fastener openings 70, 72, 76 as shown in FIG. 28. The fastener 92 has a passage defined therethrough. A clip 94 extends through the passage as shown in FIG. 28. When the lower end portion of the elongate support member 68 and the resilient interface member 74 are positioned in the receptacle 86 as shown in FIG. 28, the lip 85 is positioned in contact with a surface of a shoulder 89 located within the receptacle 86. The lip 85 is also positioned in contact with a distal end of the elongate support member 68 as shown in FIG. 28. The shoulder 89 is defined by the frame 26 as shown in FIGS. 8 and 28. Also, the resilient interface member 74 is configured and positioned so that no physical contact occurs between the elongate support member 68 and the receptacle 86 when both the elongate support member 68 and the resilient interface member 74 are positioned in the receptacle 86 as shown in FIG. 28. Also, as shown in FIG. 28, each of the plurality of ribs 90 of the sleeve 78 is positioned in contact with an inner sidewall of the receptacle 86.

The fan assembly 10 further includes a top cover 93 that defines a cavity 95 as shown in FIG. 1. The cover 93 is secured to the housing portion 48 so that the lower end portion of the elongate support member 68, the resilient interface member 74, and the receptacle 86 are positioned in the cavity 95 as shown in FIG. 1.

Figure 29:
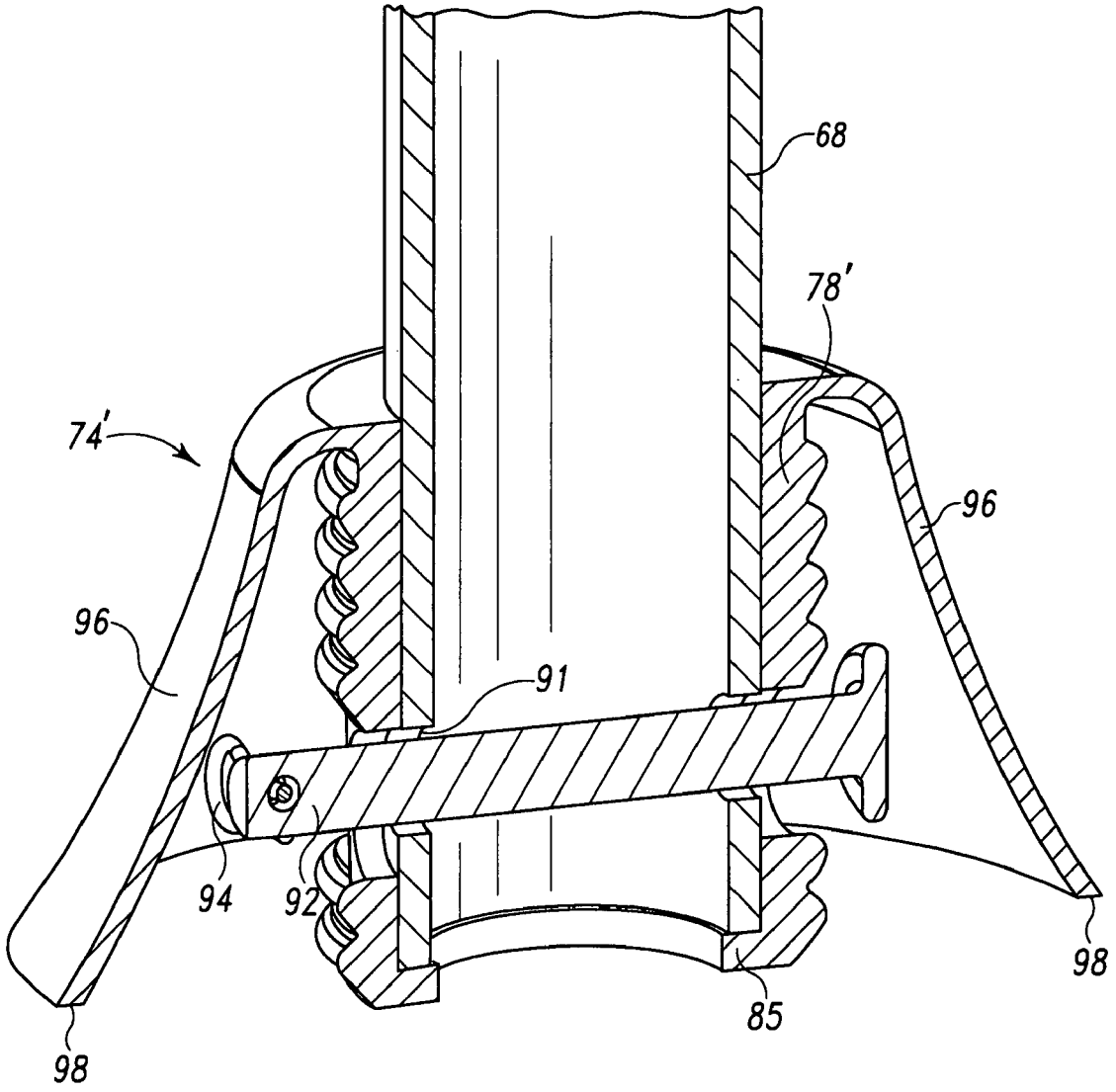
FIG. 29 is a cross sectional view of the elongate support member and an alternative resilient interface member configured in accordance with the present disclosure.
Figure 30:
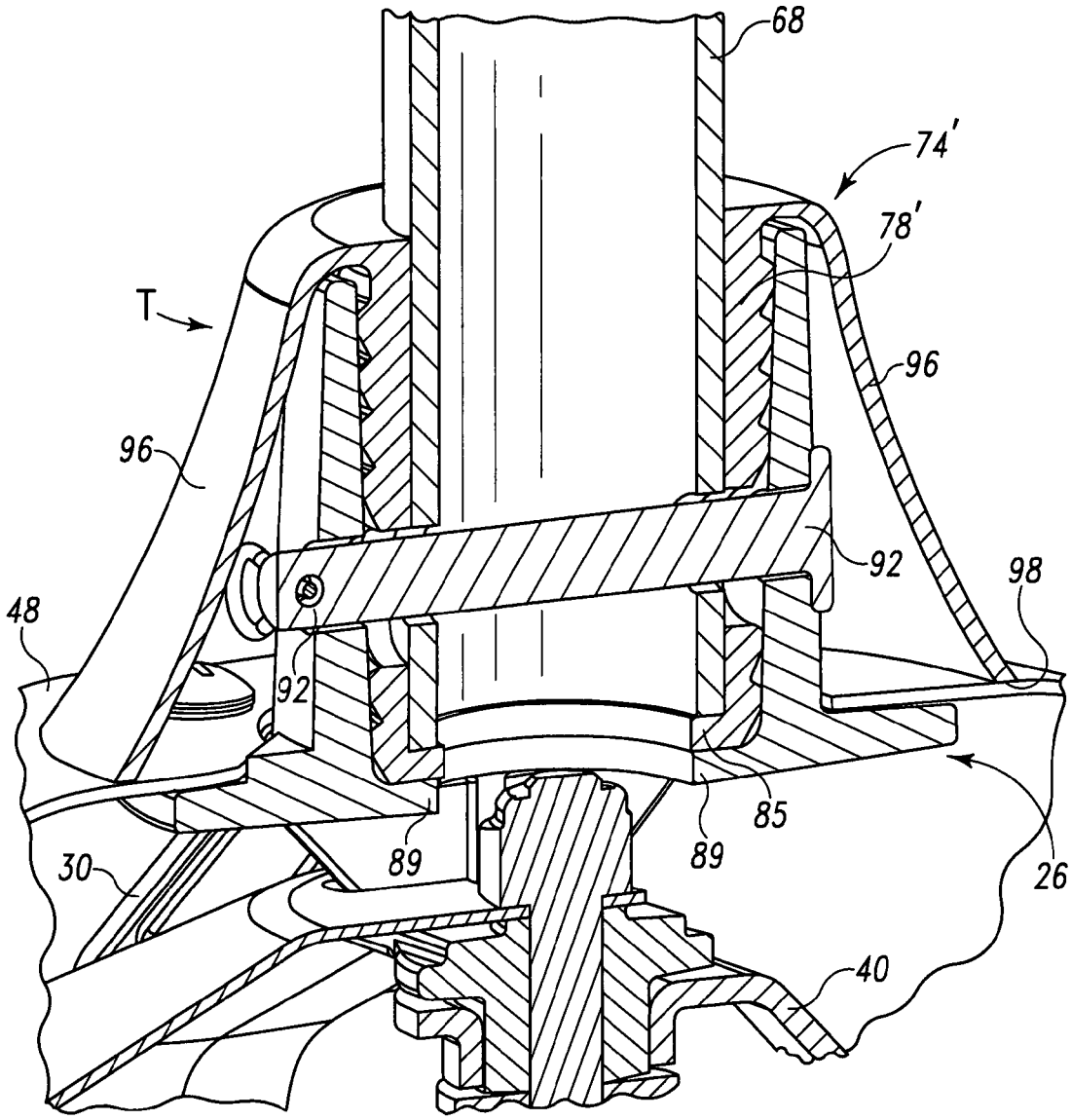
FIG. 30 is a cross sectional view of the elongate support member, the receptacle, and the alternative resilient interface member of FIG. 29.

In an alternative configuration, the resilient interface member 74' is provided with a skirt 96 that extends circumferentially from an end of the sleeve 78" as shown in FIGS. 29-30. The skirt 96 is configured so that a lower end 98 of the skirt 96 is positioned in contact with an outer surface of the housing portion 48 as shown in FIG. 30. In this alternative configuration, the top cover 93 would not be utilized since the skirt 96 performs essentially all the functions provided by the top cover 93.

Figure 31:
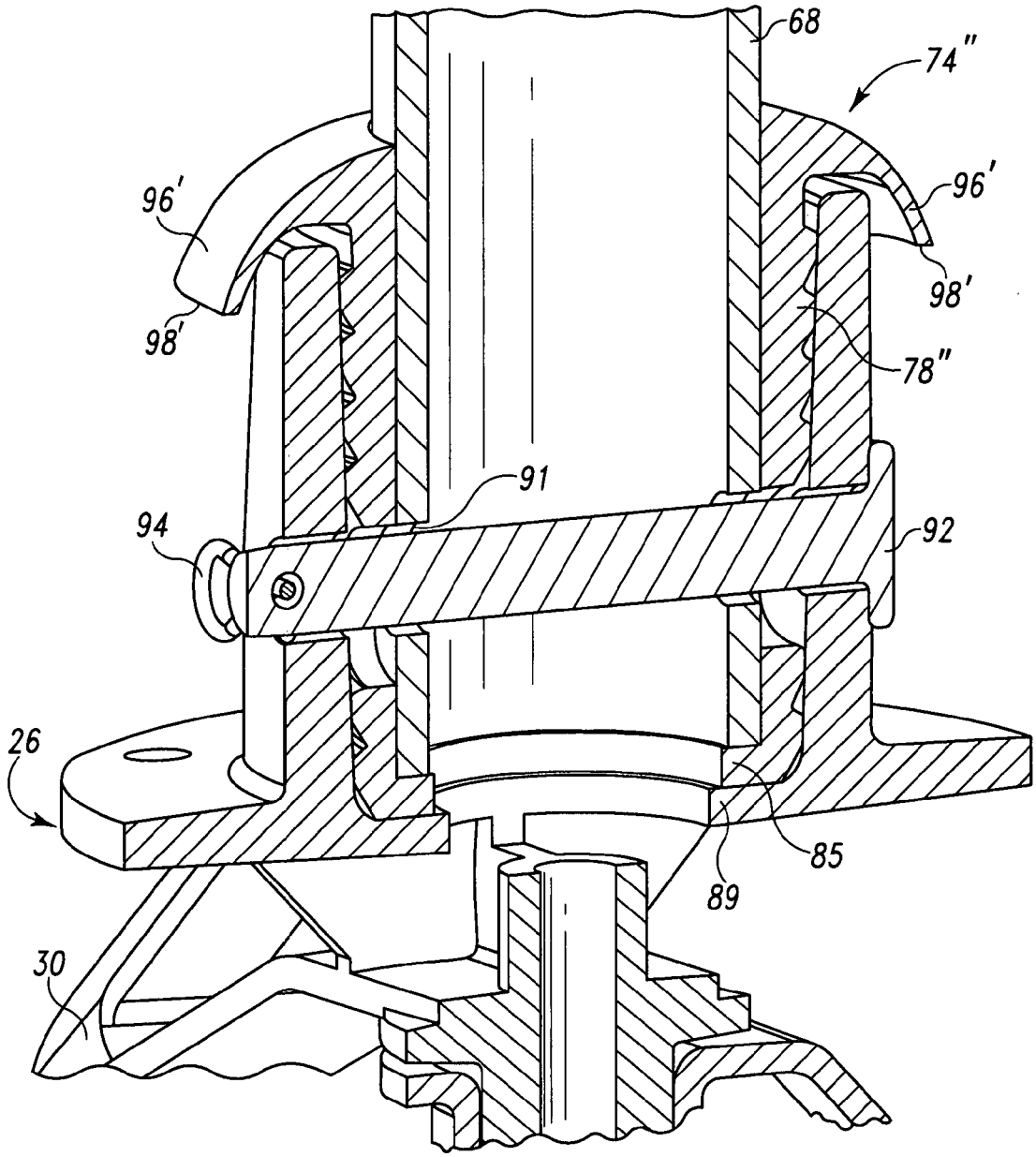
FIG. 31 is a cross sectional view of the elongate support member, the receptacle, and a yet another alternative resilient interface member configured in accordance with the present disclosure.

In yet another alternative configuration, the resilient interface member 74" is provided with a skirt 96' that extends circumferentially from an end of the sleeve 78' as shown in FIG. 31. However, the lower end 98' of the skirt 96' extends only part of the way to the outer surface of the housing portion 48. As shown in FIG. 30, the lower end 98' of the skirt would only extend to a location T. FIG. 31 shows the amount of extension of the skirt 96' in a direction towards the housing portion 48.

The resilient interface member 68 is made from an elastomeric material. Alternatively, the resilient interface member 68 may be made from any other material that possesses the physical characteristic of being deformable upon application of a load, yet being able to return to its original shape when the load is removed. Examples of suitable elastomeric materials are EPDM (ethylene propylene diene rubber) and EPM (ethylene propylene rubber). One elastomeric material from which the resilient interface member 68 may be made is an EPDM material sold under the trademark NORDEL® which is a trademark of E. I. Du Pont de Nemours and Company of Wilmington, Del. Other examples of elastomeric materials from which the resilient interface member 68 may be made are natural rubber, polybutadiene, and polyurethane.

Figure 32:
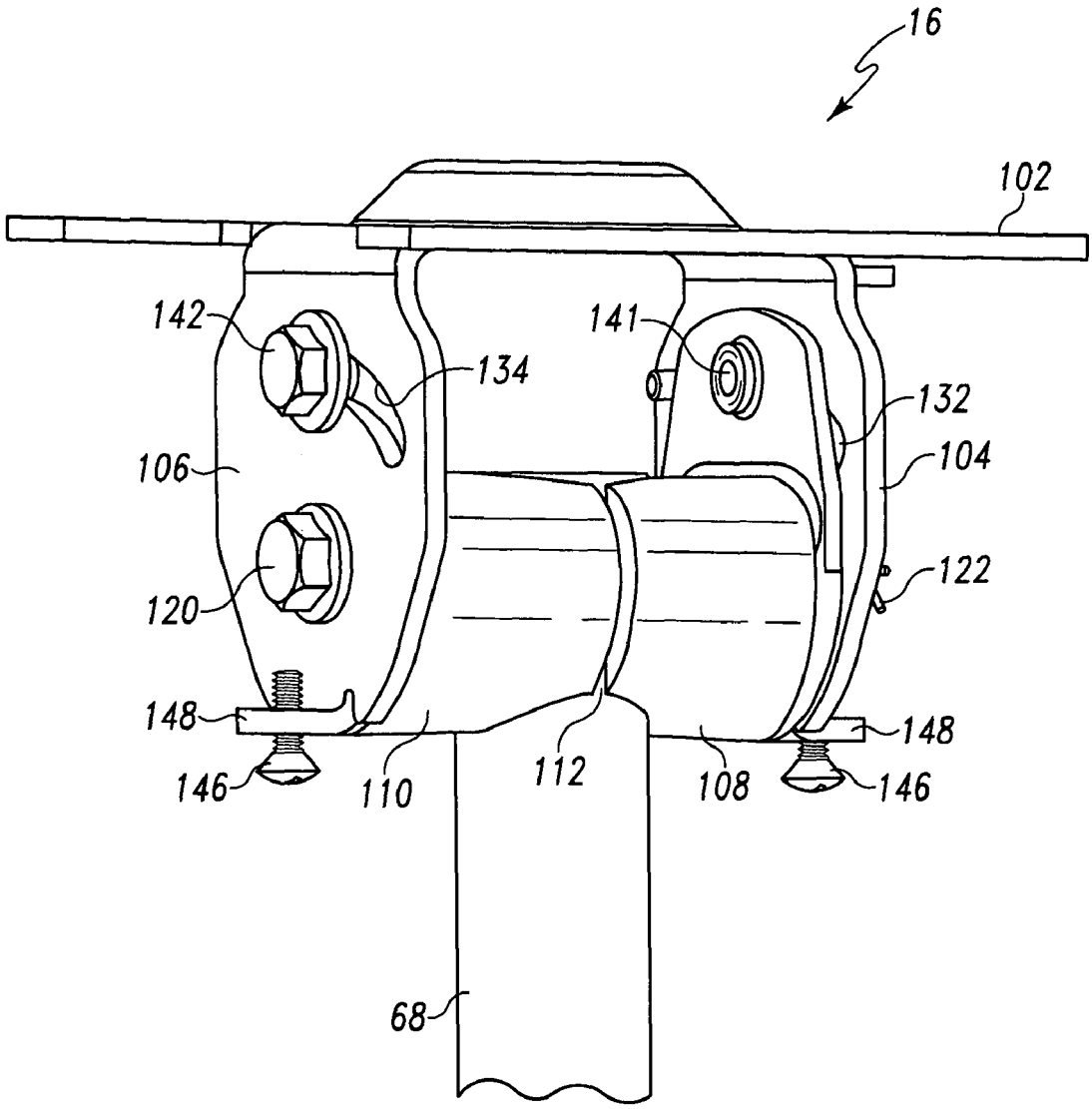
FIG. 32 is a perspective view of a bracket assembly and the elongate support member of the fan assembly of FIG. 1, with the bracket assembly and the elongate support member situated in a relative arrangement that is useful for mounting the fan assembly to a conventional horizontally-oriented ceiling.
Figure 33:
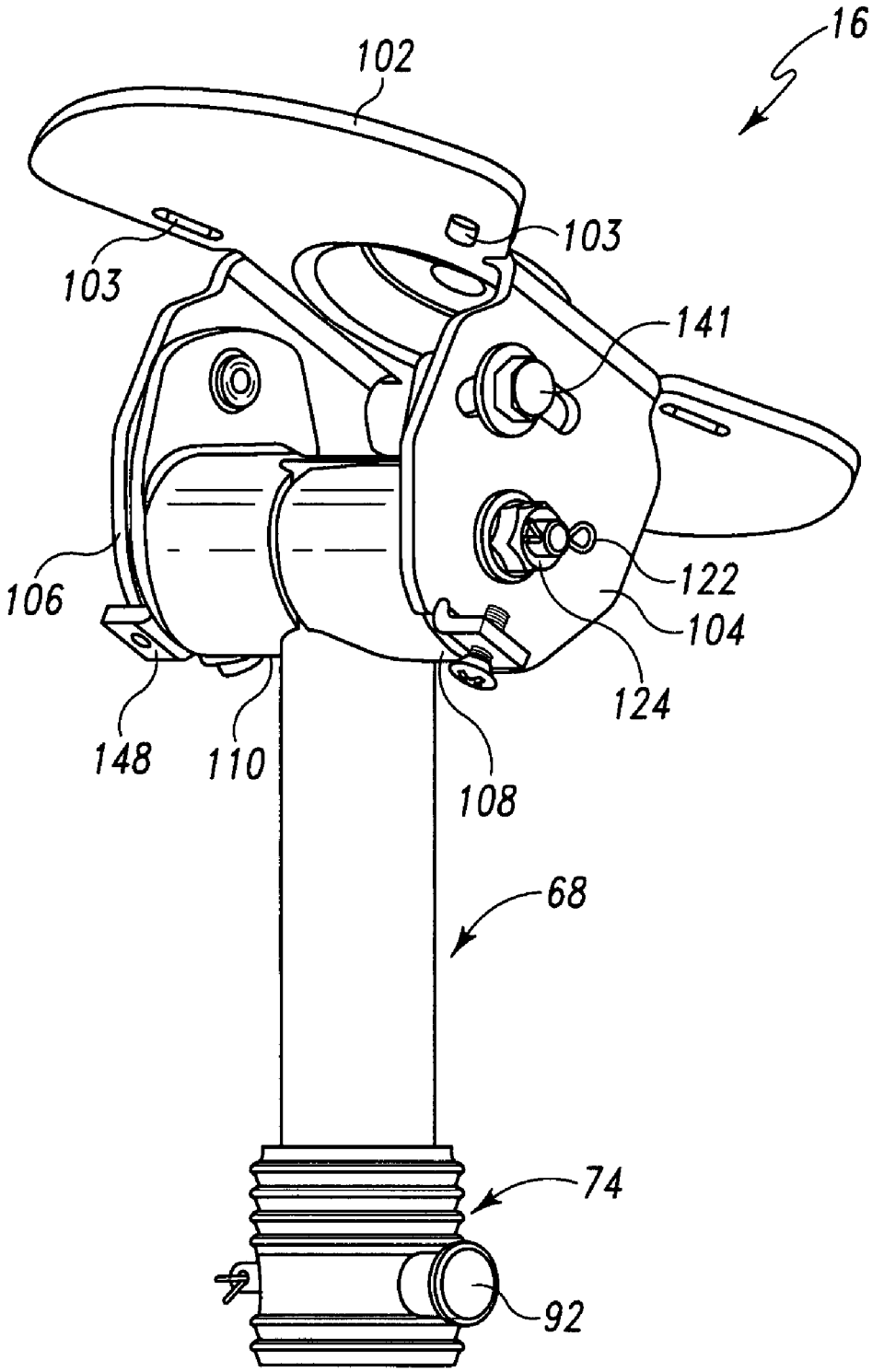
FIG. 33 is another perspective view of a bracket assembly and the elongate support member of the fan assembly of FIG. 1, with the bracket assembly and the elongate support member situated in a relative arrangement that is useful for mounting the fan assembly to a sloped ceiling.

In order to facilitate mounting of the fan assembly 10 to an overhead structure such as a ceiling (not shown), the fan assembly further includes the bracket assembly 16 as shown in FIGS. 32-33. The bracket assembly 16 includes a base 102, a first support 104 extending from the base, and a second support 106 extending from the base. The base 102 has defined therein a plurality of fastener openings 103 through which fasteners (not shown) extend to thereby mount the bracket assembly 16 to an overhead structure. The bracket assembly 16 further includes a first jaw 108 interposed between the first support 104 and the second support 106, and a second jaw 110 interposed between the first support 104 and the second support 106. The first jaw 108 and the second jaw 110 are spaced apart from each other to define a space 112. The upper end portion of the elongate support member 68 is positioned within the space 112 as shown in FIGS. 32-33.

The jaws 108, 110 are each made from a metallic material. Preferably, the metallic material is aluminum. Alternatively, the jaws may be made from a rubber material.

Figure 34:
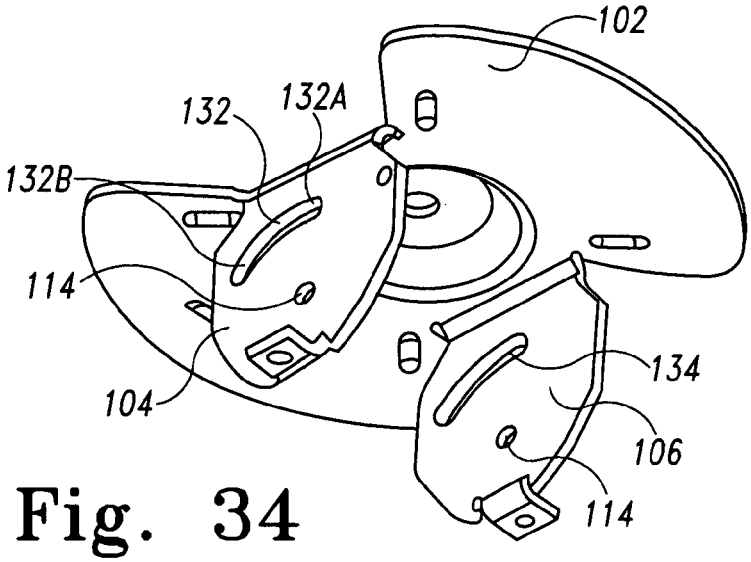
FIG. 34 is a perspective view of the base, the first support, and the second support of the bracket assembly of FIG. 32.
Figure 38:
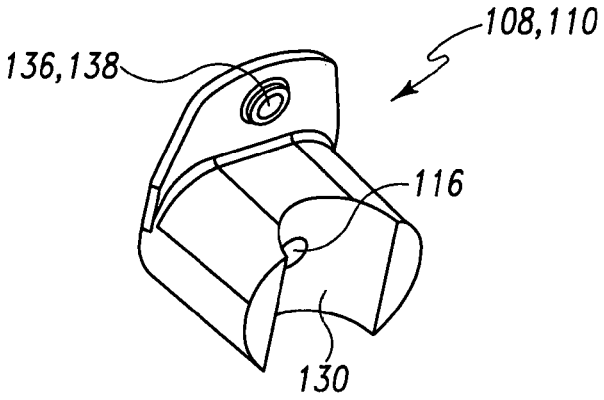
FIG. 38 is a perspective view of each jaw of the bracket assembly of FIG. 32.
Figure 37:
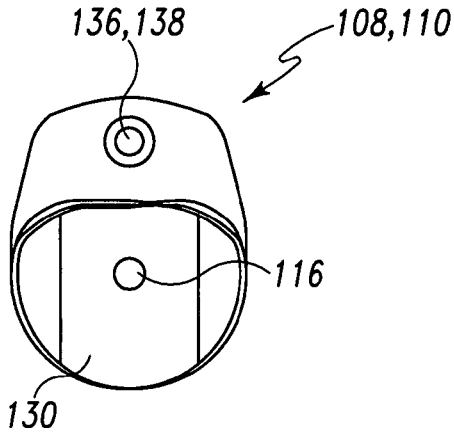
FIG. 37 is a side elevational view of each jaw of the bracket assembly of FIG. 32.
Figure 40:
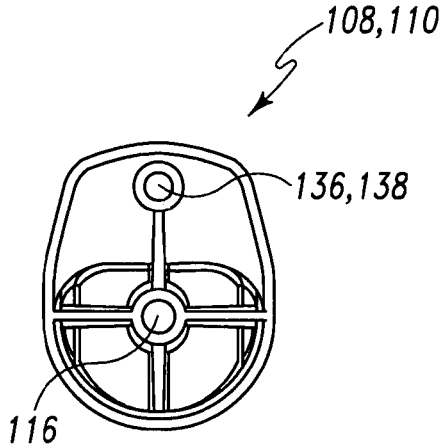
FIG. 40 is another side elevational view of each jaw of the bracket assembly of FIG. 32.
Figure 39:
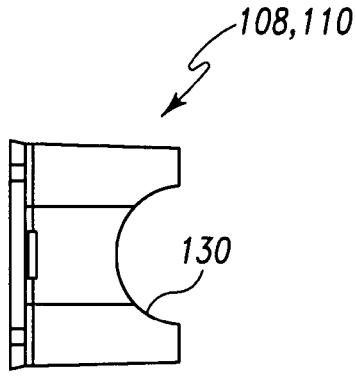
FIG. 39 is a top elevational view of each jaw of the bracket assembly of FIG. 32.
Figure 41:
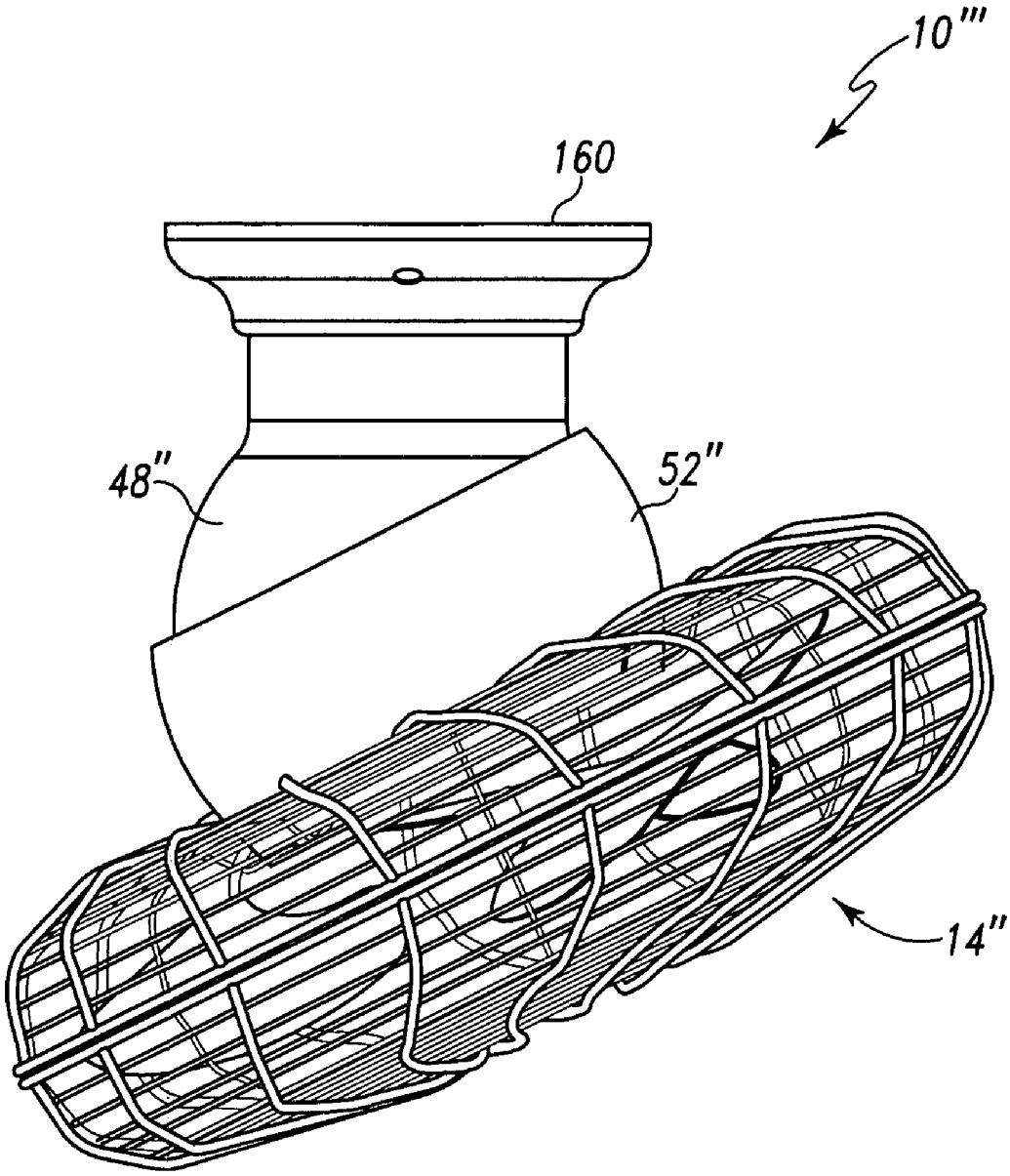
FIG. 41 is a side elevational view of still a further alternative fan assembly according to the present disclosure.

Each of the supports 104, 106 includes a fastener opening 114 as shown in FIG. 34. In addition, each of the jaws 108, 110 includes a fastener opening 116 as shown in FIGS. 37-38 and 40. A fastener 120 extends through all of the fastener openings 114, 116. The fastener 120 has a passageway defined therein through which a clip 122 extends. A nut 124 is threaded onto a threaded portion 126 defined by the fastener 120 prior to advancing the clip 122 through the fastener passage. Tightening of the nut 124 onto the fastener 120 causes the first support 104 to move toward the second support 106. Such relative movement of the supports 104, 106 causes clamping of the upper end portion of the elongate support member 68 between the jaws 108, 110. To facilitate clamping of the elongate support member 68 by the jaws 108, 110, each of the jaws 108, 110 is configured to possess a concave surface 130 which contacts the cylindrically-shaped support member 68 in a snug manner. Each of the concave surfaces 130, when viewed in an elevational view, defines an arcuate segment of a circle as shown in FIG. 39.

The first support 104 has an arcuate slot 132 defined therein, while the second support 106 has an arcuate slot 134 defined therein. The first jaw 108 has a fastener opening 136 defined therein that is aligned with the first arcuate slot 132. In addition, the second jaw 110 has a fastener opening 138 defined therein that is aligned with the second arcuate slot 134. A fastener 141 extends through the first arcuate slot 132 and the fastener opening 136 to thereby secure the first jaw 108 in fixed relation to the first support 104. Similarly, a fastener 142 extends through the second arcuate slot 134 and the fastener opening 138 to thereby secure the second jaw 110 in fixed relation to the second support 106.

Figure 35:
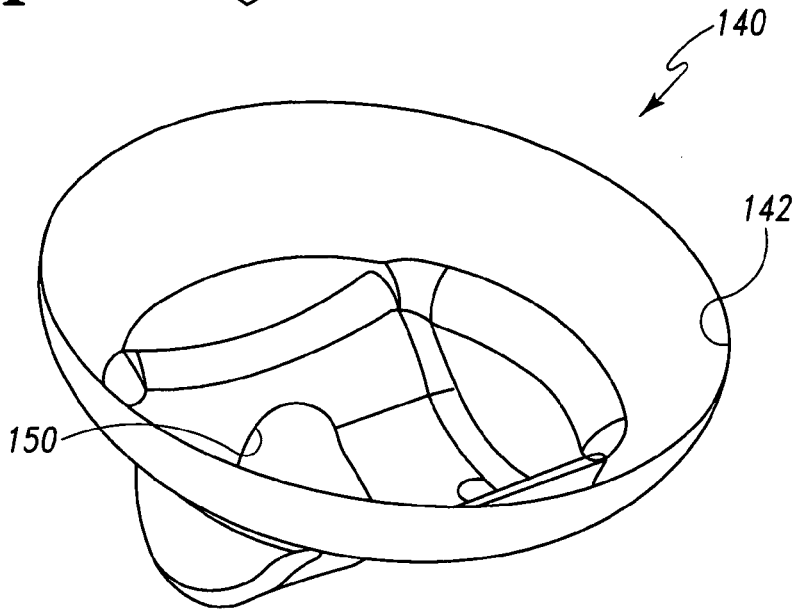
FIG. 35 is a perspective view of a cover of the fan assembly of FIG. 1 that is configured to be attached to the bracket assembly of FIG. 32.
Figure 36:
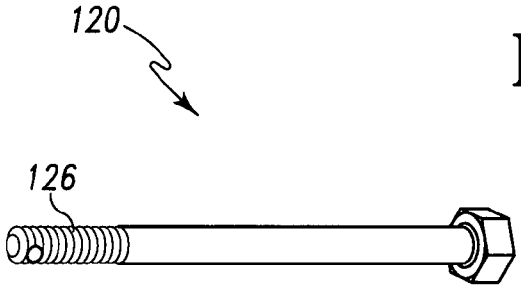
FIG. 36 is a perspective view of a bolt of the bracket assembly of FIG. 32.

The fan assembly 10 further includes a cover 140 that defines a cavity 142 as shown in FIG. 35. The cover 140 is secured to the bracket assembly 16 so that the bracket assembly is positioned within the cavity 142 as shown in FIG. 1. The cover 140 is secured with fasteners 146 to a pair of mounting flanges 148 extending from the supports 104, 106. The cover 140 defines another opening 150 through which the elongate support member 68 extends.

The arcuate slot 132 has a first end section 132A and an opposite second end section 132B as shown in FIG. 34. The elongate support member 68 extends through the opening 150 when the fastener 141 is located in the first end section of the arcuate slot 132 (see FIG. 32). In addition, the elongate support member 68 extends through the opening 150 when the fastener 141 is located in the opposite second end section of the arcuate slot 132 (see FIG. 33). It should be appreciated that the relative arrangement of the bracket assembly 16 and the elongate support member 68 shown in FIG. 32 is useful for mounting the fan assembly 10 to a conventional horizontally-oriented ceiling. In contrast, it should be appreciated that the relative arrangement of the bracket assembly 16 and the elongate support member 68 shown in FIG. 33 is useful for mounting the fan assembly 10 to a sloped ceiling.

In an alternative embodiment, the fan assembly 10''' is configured as a "hugger" type fan in which the bracket assembly 16 is not incorporated into the assembly to secure the assembly to a ceiling. Rather, the fan assembly 10''' includes a base 160 that is mounted to a ceiling with fasteners (not shown). The first housing portion 48'' is secured to the base 160 by fasteners (not shown). Alternatively, the first housing portion 48'' and the base 160 may be integrally formed together such as in a molding process. During operation of the fan assembly 10''', the fan blade assembly 14'' (as well as the housing portion 52') is moved in an orbital path of movement in a manner similar to that hereinabove describe with respect to the fan assembly 10 as depicted in FIGS. 2-6.

There is a plurality of advantages arising from the various features of each of the embodiments of the assembly described herein. It will be noted that alternative embodiments of the assembly may not include all of the features described yet still benefit from at least some of the advantages of such features. Those of ordinary skill in the art may readily devise their own implementations of the assembly that incorporates one or more of the features and fall within the spirit and scope of the present invention as defined by the appended claims.

What is claimed is:

1. A fan assembly, comprising:

an elongate support member having an end portion that has a first fastener opening defined therein;

a motor assembly including (i) a motor having an output shaft, and (ii) a support assembly that supports said motor, said support assembly having a receptacle configured to receive said end portion of said elongate support member therein, and said receptacle having a second fastener opening defined therein;

at least one fan blade coupled to said output shaft of said motor so that rotation of said output shaft causes rotation of said at least one fan blade;

a resilient interface member having a third fastener opening defined therein, said resilient interface member being (i) positioned within said receptacle, and (ii) interposed between said end portion of said elongate support member and receptacle; and a fastener extending through said first fastener opening, said second fastener opening, and said third fastener opening.

2. The fan assembly of claim 1, wherein said resilient interface member is configured and positioned so that no physical contact occurs between said elongate support member and said receptacle when both said resilient interface member and said end portion of said elongate support member are positioned within said receptacle.

3. The fan assembly of claim 1, further comprising a clip, wherein:

said fastener includes a pin having a passage defined therethrough, said clip extends through said passage of said pin.

4. The fan assembly of claim 1, wherein:

said resilient interface member includes a sleeve that defines a central passageway, said end portion of said elongate support member is located within said central passageway, and said third fastener opening is defined in a sidewall of said sleeve.

5. The fan assembly of claim 4, wherein:

said sleeve has (i) a first end defining a first orifice, and (ii) a second end defining a second orifice, said elongate support member extends through said first orifice, said sleeve further has a lip located at said second end that defines said second orifice, and said end portion of said elongate member is positioned in contact with said lip.

6. The fan assembly of claim 5, wherein:

said support assembly of said motor assembly includes a shoulder having a surface located within said receptacle, and said lip of said sleeve is positioned in contact with said surface of said shoulder.

7. The fan assembly of claim 1, wherein:

said resilient interface member includes a sleeve defining a central passageway, said sleeve defines an interior sidewall surface and an exterior sidewall surface, said end portion of said elongate support member is positioned in contact with said interior sidewall surface, said exterior sidewall surface defines a plurality of ribs, each of said plurality of ribs extending around elongate support member, and said plurality of ribs is positioned in contact with said receptacle.

8. The fan assembly of claim 1, wherein:

said elongate support member is a cylindrically-shaped support member, and said receptacle of said support assembly includes a cylindrically-shaped sidewall.

9. The fan assembly of claim 1, wherein:

said resilient interface member includes a sleeve having (i) a first end that defines a first orifice, and (ii) a second end that defines a second orifice, and (iii) a central passageway extending from said first orifice to said second orifice, and said sleeve further includes a skirt that extends from said first end.

10. The fan assembly of claim 9, wherein:

said motor assembly further includes a housing defining a cavity, said motor is positioned within said housing, and said skirt is positioned in contact with said housing.

11. The fan assembly of claim 10, wherein:

said skirt includes an upper end and a lower end, said upper end is secured to said first end of said sleeve, and said lower end is positioned in contact with said housing.

12. The fan assembly of claim 11, wherein:

said elongate support member extends through said first orifice, said sleeve further has a lip located at said second end that defines said second orifice, and said end portion of said elongate member is positioned in contact with said lip.

13. The fan assembly of claim 9, wherein:

said motor assembly further includes a housing defining a cavity, said motor is positioned within said housing, and said skirt is spaced apart from said housing.

14. The fan assembly of claim 13, wherein:

said skirt includes an upper end and a lower end, said upper end is secured to said first end of said sleeve, and said lower end is spaced apart from said housing.

15. The fan assembly of claim 14, wherein:

said elongate support member extends through said first orifice, said sleeve further has a lip located at said second end that defines said second orifice, and said end portion of said elongate member is positioned in contact with said lip.

16. A fan assembly, comprising:

an elongate support member having an end portion;

a motor assembly including (i) a motor having an output shaft, and (ii) a support assembly that supports said motor, said support assembly having a receptacle defining an interior sidewall;

at least one fan blade coupled to said output shaft of said motor so that rotation of said output shaft causes rotation of said at least one fan blade; and an elastomeric interface member interposed between said end portion of said elongate support member and said interior sidewall of said receptacle.

17. The fan assembly of claim 16, further comprising a fastener extending through each of (i) said end portion of said elongate support member, (ii) said receptacle, and (iii) said elastomeric interface member.

18. The fan assembly of claim 17, further comprising a clip, wherein:

said fastener includes a pin having a passage defined through a shaft thereof, and said clip extends through said passage of said shaft.

19. The fan assembly of claim 16, wherein said elastomeric interface member is configured and positioned so that no physical contact occurs between said elongate support member and said receptacle when both said elastomeric interface member and said end portion of said elongate support member are positioned within said receptacle.

20. The fan assembly of claim 16, wherein:

said elastomeric interface member includes a sleeve that defines a central passageway, and said end portion of said elongate support member is located within said central passageway.

21. The fan assembly of claim 20, wherein:

said sleeve has (i) a first end defining a first orifice, and (ii) a second end defining a second orifice, said elongate support member extends through said first orifice, said sleeve further has a lip located at said second end that defines said second orifice, and said end portion of said elongate member is positioned in contact with said lip.

22. The fan assembly of claim 21, wherein:

said support assembly of said motor assembly includes a shoulder having a surface located within said receptacle, and said lip of said sleeve is positioned in contact with said surface of said shoulder.

23. The fan assembly of claim 16, wherein:

said elastomeric interface member includes a sleeve defining a central passageway, said sleeve defines an interior sidewall surface and an exterior sidewall surface;

said end portion of said elongate support member is positioned in contact with said interior sidewall surface, said exterior sidewall surface defines a plurality of ribs, each of said plurality of ribs extending around elongate support member, and said plurality of ribs is positioned in contact with said receptacle.

24. The fan assembly of claim 16, wherein:

said elongate support member is a cylindrically-shaped support member, and said receptacle of said support assembly includes a cylindrically-shaped sidewall.

25. The fan assembly of claim 16, wherein:

said elastomeric interface member includes a sleeve having (i) a first end that defines a first orifice, and (ii) a second end that defines a second orifice, and (iii) a central passageway extending from said first orifice to said second orifice, and said sleeve further includes a skirt that extends from said first end.

26. The fan assembly of claim 25, wherein:

said motor assembly further includes a housing defining a cavity, said motor is positioned within said housing, and said skirt is positioned in contact with said housing.

27. The fan assembly of claim 26, wherein:

said skirt includes an upper end and a lower end, said upper end is secured to said first end of said sleeve, and said lower end is positioned in contact with said housing.

28. The fan assembly of claim 27, wherein:

said elongate support member extends through said first orifice, said sleeve further has a lip located at said second end that defines said second orifice, and said end portion of said elongate member is positioned in contact with said lip.

29. The fan assembly of claim 25, wherein:

said motor assembly further includes a housing defining a cavity, said motor is positioned within said housing, and said skirt is spaced apart from said housing.

30. The fan assembly of claim 29, wherein:

said skirt includes an upper end and a lower end, said upper end is secured to said first end of said sleeve, and said lower end is spaced apart from said housing.

31. The fan assembly of claim 30, wherein:

said elongate support member extends through said first orifice, said sleeve further has a lip located at said second end that defines said second orifice, and said end portion of said elongate member is positioned in contact with said lip.

32. A fan assembly, comprising:

an elongate support member;

a motor assembly including (i) a motor having an output shaft, and (ii) a support assembly that supports said motor;

at least one fan blade coupled to said output shaft of said motor so that rotation of said output shaft causes rotation of said at least one fan blade; and an elastomeric interface member, wherein one of said support assembly and said elongate support member includes a receptacle, wherein the other of said support assembly and said elongate support member includes a part thereof that is positioned within said receptacle, and wherein said elastomeric interface member is interposed between said receptacle and said part.

33. The fan assembly of claim 32, further comprising a fastener extending through each of (i) said part, (ii) said receptacle, and (iii) said elastomeric interface member.

34. The fan assembly of claim 33, further comprising a clip, wherein:

said fastener includes a pin having a passage defined through a shaft thereof, and said clip extends through said passage of said shaft.

35. The fan assembly of claim 32, wherein said elastomeric interface member is configured and positioned so that no physical contact occurs between said part and receptacle when both said elastomeric interface member and said part are positioned within said receptacle.

36. The fan assembly of claim 32, wherein:

said elastomeric interface member includes a sleeve that defines a central passageway, and said part is located within said central passageway.

37. The fan assembly of claim 36, wherein:

said sleeve has (i) a first end defining a first orifice, and (ii) a second end defining a second orifice, said part extends through said first orifice, said sleeve further has a lip located at said second end that defines said second orifice, and said part is positioned in contact with said lip.

38. The fan assembly of claim 37, wherein:

a shoulder having a surface which is located within said receptacle, and said lip of said sleeve is positioned in contact with surface of said shoulder.

* * * * *